US005855237A

United States Patent [19]

Okada et al.

[11] Patent Number: 5,855,237

[45] Date of Patent: Jan. 5, 1999

[54] CASTING METHOD WITH IMPROVED RESIN CORE REMOVING STEP AND APPARATUS FOR PERFORMING THE METHOD

[75] Inventors: Yuji Okada; Hirokazu Shirakawa; Shuichi Tomitaka; Masamichi Okada; Takayuki Kato, all of Toyota, Japan

[73] Assignee: Toyota Jidosha Kabushiki Kaisha, Toyota, Japan

[21] Appl. No.: 826,767

[22] Filed: Apr. 7, 1997

Related U.S. Application Data

[63] Continuation of Ser. No. 445,496, May 31, 1995, abandoned.

[30] Foreign Application Priority Data

| | | | |
|---|---|---|---|
| Jun. 1, 1994 | [JP] | Japan | 6-120279 |
| Jun. 10, 1994 | [JP] | Japan | 6-129014 |
| Jun. 20, 1994 | [JP] | Japan | 6-136201 |
| Jul. 6, 1994 | [JP] | Japan | 6-155015 |
| Aug. 8, 1994 | [JP] | Japan | 6-186059 |
| Sep. 22, 1994 | [JP] | Japan | 6-227951 |

[51] Int. Cl.[6] ..... B22C 1/00; B22C 9/10; B22D 29/00

[52] U.S. Cl. ..... 164/113; 164/132; 164/369; 164/520

[58] Field of Search ..... 164/369, 520, 164/529, 132, 131, 113

[56] References Cited

U.S. PATENT DOCUMENTS

| | | | |
|---|---|---|---|
| 4,462,455 | 7/1984 | Henych et al. | 164/369 |
| 5,566,742 | 10/1996 | Nemoto | 164/132 |

FOREIGN PATENT DOCUMENTS

| | | |
|---|---|---|
| 56-95447 | 8/1981 | Japan . |
| 61-293646 | 12/1986 | Japan . |
| 3-66445 | 3/1991 | Japan . |
| 4-189523 | 7/1992 | Japan . |
| 6-91345 | 4/1994 | Japan . |
| 6-91656 | 4/1994 | Japan . |
| 6-99247 | 4/1994 | Japan . |
| 6-99436 | 4/1994 | Japan . |
| 6-122037 | 5/1994 | Japan . |
| 6-126376 | 5/1994 | Japan . |
| 6-3218195 | 11/1994 | Japan . |

*Primary Examiner*—Kuang Y. Lin

*Attorney, Agent, or Firm*—Oblon, Spivak, McClelland, Maier & Neustadt, P.C.

[57] ABSTRACT

In a casting process using a resin core, sometimes molten resin remains in a cast product after the steps of withdrawal of the resin core from the cast product. In order to solve the problem, as a material of the resin core, a resin which is hard and not deformed against high temperature and high pressure of molten metal until the molten metal is solidified and is softened with an increase of temperature beyond the temperature at which the metal is solidified is used. The resin core is withdrawn from the cast product after it is softened but before it is melted. The softened core is pulled out from the cast product without being broken apart.

87 Claims, 28 Drawing Sheets

CASTING METHOD WITH IMPROVED RESIN CORE REMOVING STEP AND APPARATUS FOR PERFORMING THE METHOD

This application is a continuation of application Ser. No. 08/445,496, filed on May 31, 1995, now abandoned.

BACKGROUND OF THE INVENTION

1. Field of the Invention

This invention relates to a casting technique using resin cores and, more particularly, to a casting technique with an improved step of removing a resin core from a cast product.

2. Description of the Prior Art

In casting, cores are used to cast hollow products. The core should have a mechanical strength sufficient to maintain its shape against the heat and pressure of molten metal during the casting. In addition, it is required to have a readily breaking property, that is, it should be comparatively readily broken to permit its ready removal from the cast product after the casting. Currently, sand cores which are formed by using sand and a thermosetting resin are extensively used.

The sand core has such disadvantages that its preparation requires many steps and that it is readily damaged when the casting pressure is increased during the casting, and there are proposals of using resin cores in lieu of sand cores.

The resin core is formed by using a thermoplastic resin, and it can satisfy the following two properties when the proper type of resin to be used is selected.

The first one of the properties is that the resin core maintains sufficient mechanical strength to maintain its shape against the heat and pressure of the molten metal poured into the casting die until the molten metal is solidified.

The second property is that the resin core that is accommodated in the cast product is melted when its temperature is further increased after the solidification of the molten metal.

When these two properties are satisfied, a hollow space having an accurate shape is formed inside the cast product, and moreover, the molten resin core is readily removed from the cast product.

In the prior art, however, in the case of removing the resin core from the cast product by melting the core, when the shape of the hollow space is complicated, the molten resin may partly remain in the cast product.

SUMMARY OF THE INVENTION

An object of the invention is to improve the step of removing the resin core so as to avoid remaining of part of resin in the cast product without being removed.

According to the invention, a resin core is used for casting. Then, after solidification of molten metal in contact with the resin core among the molten metal poured into the casting die and before melting of the resin core, the resin core in a softened state is withdrawn from the cast product. The inventors conducted various experiments and found that if a proper type of resin is selected for the resin core, after solidification of the molten metal in contact with the resin core and before melting thereof, the resin core is tentatively in a state such that it is softened and readily capable of deformation and can be completely withdrawn without being broken apart at an intermediate position by pulling an end of it. The invention is predicated in this finding. According to the invention, it is possible to prevent a part of the resin care from remaining in the cast product without being removed.

According to other aspects of the invention, it is sought to solve problems which are peculiar to the method of casting utilizing resin cores.

More specifically, another object of the invention is to accurately maintain the mutual positional relation between the casting die and the resin core. To this end, according to the invention a core print of resin core is fitted in the casting die by causing its elastic deformation. Alternatively, the resin core is fitted on a support which is rigidly secured to the die. As a further alternative, a resin core is formed around a highly rigid support so as to be positioned in the die by the support.

A further object of the invention is to permit a cast product which is obtained with solidification of molten metal surrounding a resin core to be taken out from the die without causing damage to the cast product. To this end, according to the invention, after opening the casting die push-out pins are projected from the side of the die to push out the core print of the resin core.

A still further object of the invention is to prevent the resin core from being softened or damaged by the heat of molten metal before the shape of the cast product is determined with the solidification of molten metal, thus improving the shape accuracy of the cast product. To this end, according to the invention, the resin core is covered with a heat insulating layer or reinforced with heat insulating fibers. As a further alternative, the resin core is covered with the same metal as the cast product.

A yet further object of the invention is to facilitate the withdrawal of softened resin core. To this end, according to the invention, a heat generator is provided inside the resin core. Alternatively, the resin core is made to be readily separable into a plurality of portions such that each separated portion can be withdrawn readily and reliably.

BRIEF DESCRIPTION OF THE DRAWINGS

The above and other objects, features and advantages of the invention will become more apparent from the following detailed description of the preferred embodiments when the same is read with reference to the accompanying drawings, in which.

DETAILED DESCRIPTION OF THE PREFERRED EMBODIMENTS (First Embodiment)

Figure 1A:
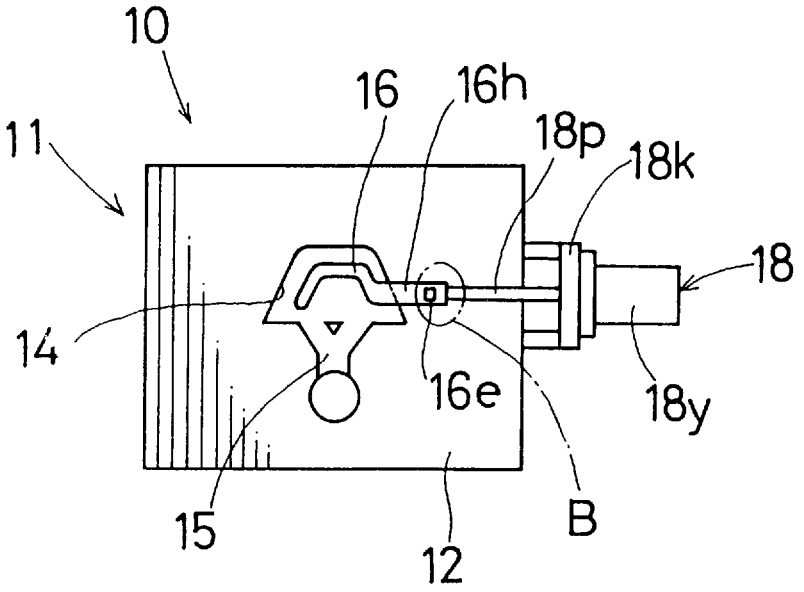
FIGS. 1(A) and 1(B) are views schematically showing the essential parts of a casting apparatus according to a first embodiment of the invention.
Figure 1B:
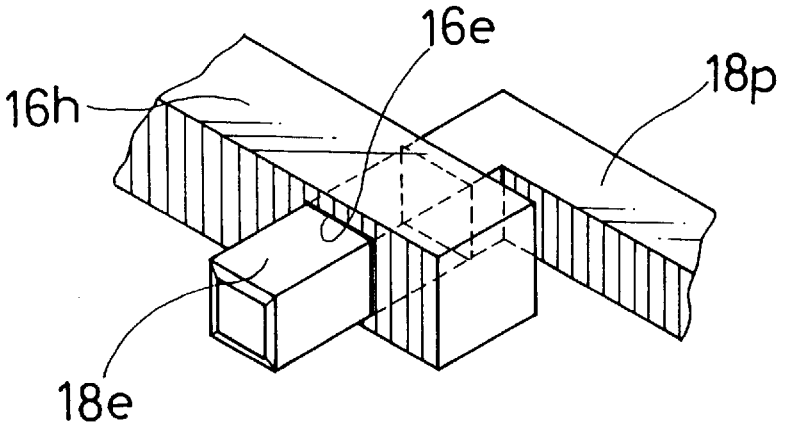

Now, a casting method and a casting apparatus according to a first embodiment of the invention will be described with reference to FIGS. 1(A), 1(B), 2 and 3(A) to 3(E). FIG. 1(A) is a schematic view showing the essential parts of a casting apparatus 10 according to the embodiment. FIG. 1(B) is a detailed view showing a portion B in FIG. 1(A).

The casting apparatus 10 is a die-casting machine for producing a cast product, and it comprises a metal casting die 11 including a stationary die half (which is on the front side of the drawings and not shown) and a movable die half 12. In the casting die 11, a cast product is formed through solidification of molten metal injected under pressure from an injector (not shown). In the closed state of the die, a cavity 14 and a sprue 15 for leading molten metal to the cavity 14 are formed inside the die.

The movable die half 12 can be moved in directions perpendicular to the plane of FIG. 1(A), and it is provided on one side with a core withdrawing mechanism 18 for positioning a resin core 16 to be described later and withdrawing the resin core 16 from the cast product at a predetermined timing.

The core withdrawing mechanism 18 includes an oil hydraulic piston-cylinder assembly 18*y* and a holder 18*k* for horizontally securing the piston-cylinder assembly 18*y* to the movable die half 12. The oil hydraulic piston-cylinder assembly 18*y* has a piston rod 18*p* having a bent end 18*e*. As shown in FIG. 1(B), the bent end 18*e* is formed by bending an angular rod into an L-shaped configuration, and it is inserted through an angular hole 16*e* formed in a core print 16*h* of the resin core 16 mentioned above. In this way, the core print 16*h* of the resin core 16 and the oil hydraulic piston-cylinder assembly 18*y* are coupled to each other, and the position of the resin core 16 both in the direction perpendicular to the plane of FIG. 1(A) and in the plane of FIG. 1(A) is determined. The stroke of the oil hydraulic piston-cylinder assembly 18*y* is set to a length which permits positioning of the resin core 16 in the cavity 14 at a predetermined position thereof with the piston rod 18*p* in the projected state and also permits withdrawing of the resin corer 16 to the outside of the cavity 14 with the piston rod 18*p* in the retreated state.

The resin core 16 is formed through injection molding a thermoplastic synthetic resin. As the thermoplastic synthetic resin, resins which have a high glass transition point (for instance around 160° C.) as well as being high in both the impact strength and the ductility, such as polycarbonate, polypropyrene, polyethylene and mixers of these compounds, may suitably be used.

Figure 2:
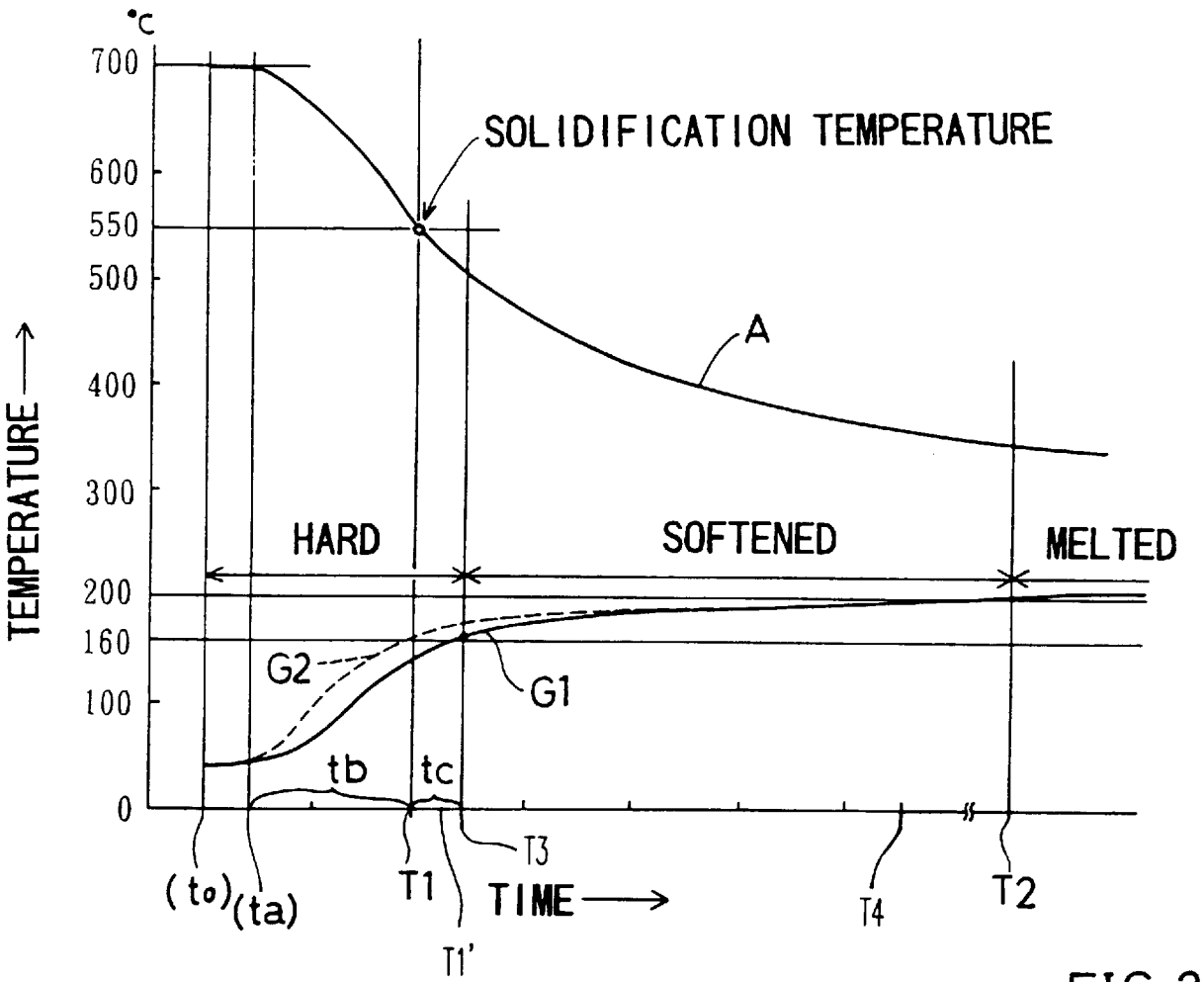
FIG. 2 is a graph showing temperature characteristics of molten metal and a resin core during casting.

FIG. 2 is a graph showing the temperature of a portion of molten metal (i.e., aluminum alloy molten metal with a solidifying temperature of 550° C.) in contact with the resin core 16 during a casting operation (hereinafter referred to as molten metal characteristic A), and also showing the average temperature of the resin core 16 which is made of polycarbonate during the casting (hereinafter referred to as resin core characteristic G1). In the graph, the ordinate is taken for the temperature, and the abscissa is taken for the time. The slopes of the molten metal and resin core characteristics A and G1 are varied depending on the shape of the cast product, disposition and size of the resin core 16 and so forth.

Time instant t0 on the time axis of the graph in FIG. 2 is the timing of commencement of pouring of molten metal into the cavity 14, and instant ta is the timing of the completion of pouring of molten metal. During the time between the instants t0 and ta, the molten metal temperature is not substantially reduced but is held at about 700° C.

The molten metal poured into the cavity 14 is cooled by the die 11 and resin core 16 and reduced in temperature, and when time tb has been passed (i.e., at instant T1) from the molten metal pouring completion instant (ta), its portion in contact with the resin core 16 is cooled down to its solidifying temperature of 550° C. and thus solidified. Meanwhile, the resin core 16 is elevated in temperature by receiving heat from the molten metal. However, since it is made of polycarbonate having low heat conductivity, the temperature of its inside is not so quickly increased when the temperature of its surface in contact with molten metal becomes substantially equal to the molten metal temperature. The temperature of the resin core 16 shown in FIG. 2 is the average temperature.

While the temperature of the resin core 16 is in a range between normal temperature and 160° C, polycarbonate is solidified, and the resin core 16 maintains high mechanical strength (this state being hereinafter referred to as hard state). When the resin core 16 is in the hard state, it is hardly deformed by a casting pressure of, for instance, about 80 MPa applied to it. Thus, it is possible to obtain the shape accuracy which is required for the cast product. As shown in FIG. 2, the thickness of the cast product, size of the resin core 16 and so forth, are set such that the resin core 16 is held in the hard state until at least a portion of the molten metal in the cavity 14 that is in contact with the resin core 16 is solidified. The graph of FIG. 2 shows that the resin core 16 is still held hard for time tc after the shape of the cast product has been determined with the solidification of the molten metal in contact with the resin core 16. Since the shape of the cast product is determined while the resin core 16 is held hard, it is possible to obtain a high shape accuracy. Depending on the shape of the cast product or other factors, the resin core 16 may be softened before solidification of molten metal (see dashed plot G2 in the drawing). In such a case, it is possible to suppress internal temperature rise of the resin core 16 and let the core characteristic G2 to approach G1 by providing a heat insulating material layer on the surface of the resin core 16.

The resin core 16 is softened when its temperature is increased beyond 160° C. However, its inner portion still has a comparatively high rigidity. In this state, although it can be withdrawn from the cast product because it can be deformed to meet the shape of the inner space formed in the cast product, it is not elongated more than is necessary or broken apart by a pulling force applied thereto. Thus, by applying a pulling force to the core print 16h of the resin core 16 from the core withdrawing mechanism 18 while the resin core 16 is softened, the whole resin core 16 can be withdrawn continuously from the cast product.

When the temperature of the resin core 16 exceeds 200° C., the resin core 16 is plasticized up to its inner portion near its center, and the average mechanical strength of the resin core 16 is thus quickly reduced. This state of the resin is referred to as melted state. When a pulling force is applied to the resin core 16 in the melted state, the resin core 16 can not withstand the force and is broken apart. Therefore, it is difficult to withdraw the resin core 16 from the cast product. In the prior art, the resin core 16 is removed from the cast product by utilizing a phenomenon that the resin core 16 is melted completely to obtain fluidity. However, the molten resin may partly remain in the cast product.

Now, the casting process with the casting technique of this embodiment will be described with reference to FIGS. 3(A) to 3(E).

Figure 3A:
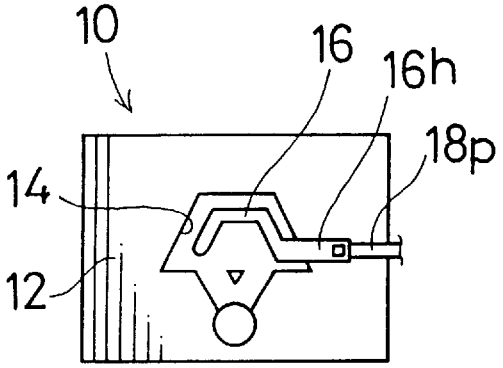
FIGS. 3(A) to 3(E) are views showing the steps of a casting method according to the first embodiment of the invention.
Figure 3B:
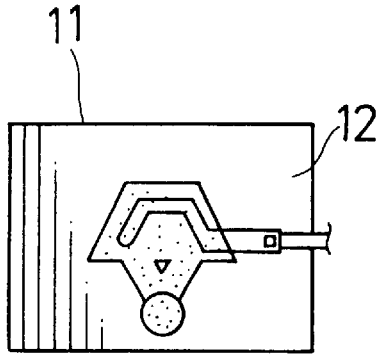
Figure 3C:
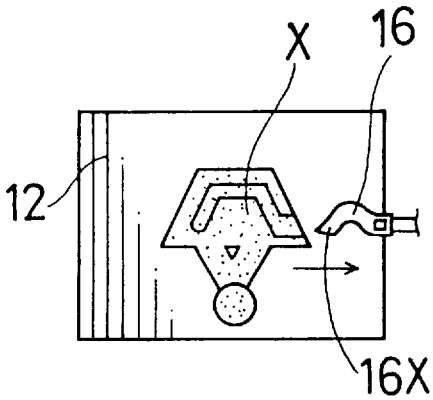

When the casting die is held open after the end of the preceding casting cycle, the resin core 16 is positioned in the cavity 14, as shown in FIG. 3(A), with engagement of the core print 16*h* of the resin core 16 in the bent end 18*e* of the oil hydraulic piston-cylinder assembly 18*y* of the core withdrawing mechanism 18. In this state, the casting die is closed, so that molten metal is poured into the die 11 as shown in FIG. 3(B). Then, application of a force for retreating the piston 18p to the oil hydraulic piston-cylinder assembly 18y is started at instant T11 (shown in FIG. 2) slightly later than the instant of solidification of the molten metal in contact with the die 11 and resin core 16 (i.e., instant T1 after lapse of time tb from the end of pouring of molten metal). At the instant T11, the resin core 16 is hard, and this state is maintained even when a pulling force is applied to the resin core 16 from the core withdrawing mechanism 18. However, while the force from the core withdrawing mechanism 18 is acting continually on the core print 16h of the resin core 16, the resin core 16 is softened with its temperature rise caused by the heat of the cast product. In the case of FIG. 2, the resin core 16 is softened at instant T3. Since the pulling force is applied continuously, when the resin core 16 is softened, it is withdrawn continuously from the cast product X as shown in FIG. 3(C). At this time, the resin core 16 is not broken apart but is withdrawn continuously and integrally until its other end 16X gets out of the cast product X.

Figure 3D:
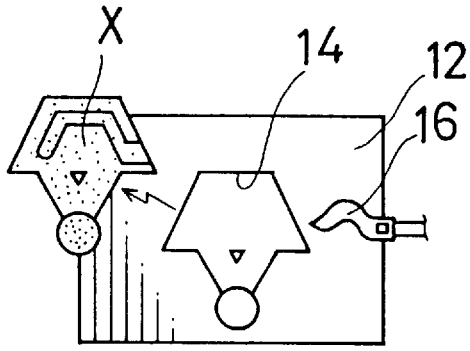
Figure 3E:
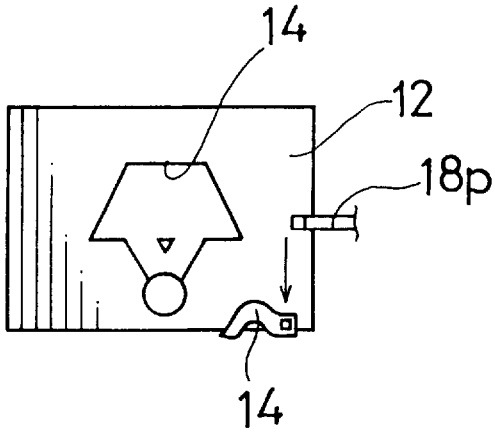

After the resin core 16 has been withdrawn in this way, the casting die is opened at instant T4 after lapse of a predetermined period of time from the instant (t0 in FIG. 2) of the start of pouring of molten metal into the die 11. Then, the cast product X is taken out from the die as shown in FIG. 3(D), and the withdrawn resin core 16 is taken out from the bent end 18*e* of the oil hydraulic piston-cylinder assembly 18*y* as shown in FIG. 3(E).

As indicated above, in this embodiment the resin core 16 is formed from polycarbonate. Polycarbonate resin cores do not significantly deform under appolied casting pressure of less than 80 MPa is typically within the tolerance for the cast product. However, casting pressures of more than 80 MPa are not usually used. Therefore, casting pressure need not be reduced to accommodate the invention. That is, the polycarbonate resin core will not deform in any substantial manner during normal casting procedures and cause shape defects to the cast products.

Further, after the shape of the cast product X has been determined by the solidification of molten metal, the pulling force from the core withdrawing mechanism 18 is applied continually to the core print 16*h* of the resin core 16. Thus, when the resin core 16 reaches the softened state brought about by the heat of the cast product X, the whole resin core 16 is withdrawn continuously and integrally. Thus, the resin core 16 is not melted to be incapable of withdrawal due to a delay of the withdrawal timing. Further, since the resin core 16 is heated by the heat of the cast product and withdrawn in the softened state, there is no need of heating the resin core 16 again for the withdrawal thereof in a subsequent step. It is thus possible to eliminate blister defect or thermal strain of the cast product X due to re-heating and to save energy thereof.

Furthermore, since the core print 16*h* of the resin core 16 is in contact with and cooled by the die 11, it is not heated directly by molten metal but is held hard. Thus, there is no possibility that the coupling between the core print 16*h* of the resin core 16 and the core withdrawing mechanism 18 becomes defective. Further, the mechanism for positioning the resin core 16 is simple in construction, that is, it positions the resin core 16 in the horizontal direction and the height direction with the engagement between the bent end 18*e* of the piston rod 18*p* of the oil hydraulic piston-cylinder assembly 18*y* and the angular hole 16*e* formed in the core print 16*h* of the resin core 16. It is thus possible to provide satisfactory maintenance property and to reduce equipment cost.

(Second Embodiment)

Figure 4A:
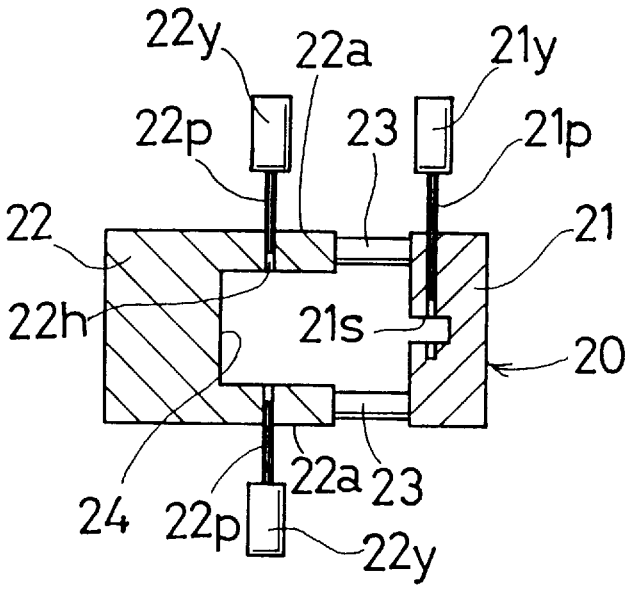
FIGS. 4(A) and 4(B) are views schematically showing the casting apparatus according to a second embodiment of the invention.
Figure 4B:
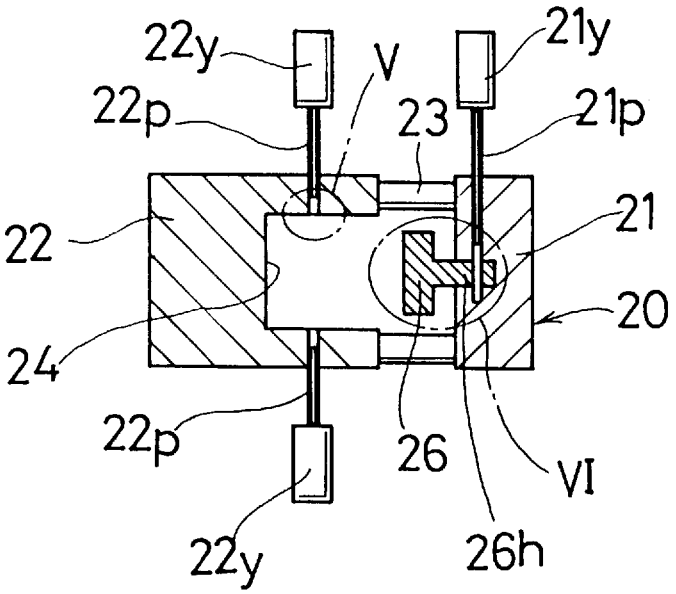
Figure 5:
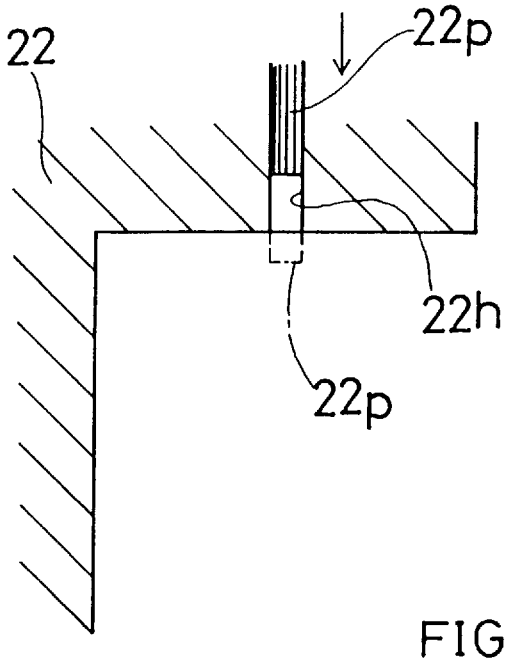
FIG. 5 is a detailed view showing a portion V in FIG. 4.
Figure 6:
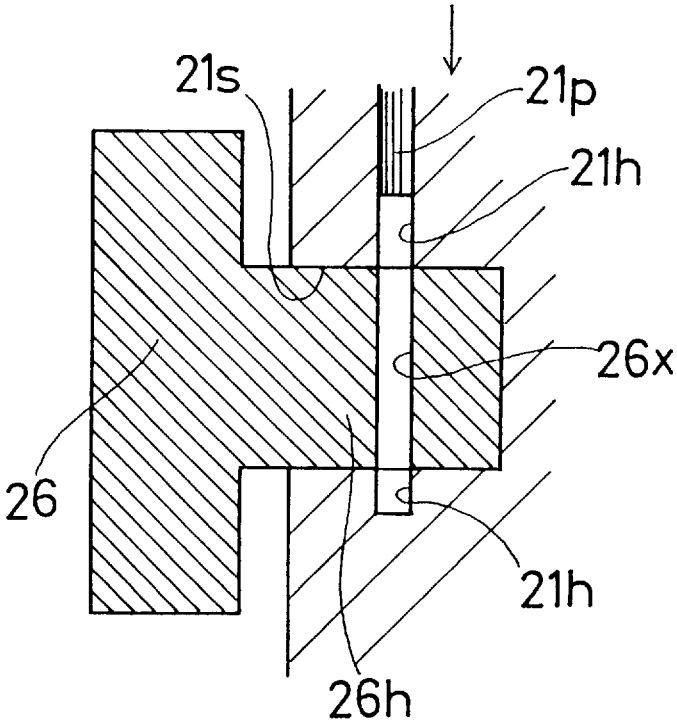
FIG. 6 is a detailed view showing a portion VI in FIG. 4.

Now, a casting method and a casting apparatus according to a second embodiment of the invention will be described with reference to FIGS. 4(A), 4(B), 5 and 6. FIGS. 4(A) and 4(B) are sectional views showing a casting apparatus 20 according to this embodiment. FIG. 5 is a detailed view showing a portion V in FIG. 4(B). FIG. 6 is a detailed view showing a portion VI in FIG. 4(B).

In the casting apparatus 20 of this embodiment, a resin core 26 has its core print 26h secured to a core print support section 21*s* of a stationary die half 21, and at the time of opening the die, it is withdrawn from the cast product which is separated together with a movable die half 22 from the stationary die half 21.

The movable die half 22 is movable to the left and the right in FIGS. 4(A) and 4(B) along tie bars 23, and when it is engaged with the stationary die half 21 by closing the die, a cavity 24 and a sprue (not shown) for leading molten metal to the cavity 24 are formed in the die.

The movable die half 22 has an upper and a lower wall 22*a* formed with respective vertical through holes 22*h*. In each vertical through hole 22*h*, a cast product set pin 22*p* is slidably inserted, as shown in FIG. 5. Each cast product set pin 22*p* is axially movable by an oil hydraulic piston-cylinder assembly 22*y*. In the casting operation, an end portion of each set pin 22*p* is projected into the cavity 24. Thus, when the die is opened after the casting, the cast product X is held secured to the movable die half 22.

The stationary die half 21, as shown in FIG. 6, has a coupling hole 21*h* formed in upper and lower portions of the core print support section 21*s* such that a core set pin 21*p* can be slidably inserted therethrough. The core set pin 21*p* can be axially moved by an oil hydraulic piston-cylinder assembly 21*y*.

As in the previous first embodiment, the resin core 26 formed by using polycarbonate or like thermoplastic synthetic resin, and its core print 26*h* can be coupled to the core print support section 21*s* of the stationary die half 21 as noted above. The core print 26*h* has a vertical through hole 26*x* which is aligned to the coupling hole 21*h* in the stationary die half 21 when the core print 26*h* is engaged with the core print support section 21*s* of the stationary die half 21. With this construction, when the core print 26h of the resin core 26 is engaged with the core print support section 21*s* of the stationary die half 21, the resin core 26 can be rigidly secured to the stationary die half 21 by inserting the core set pin 21*p* through the coupling hole 21*h* and the through hole 26*x*.

Now, the casting method according to this embodiment will be described with reference to FIGS. 7(A) to 7(F).

Figure 7A:
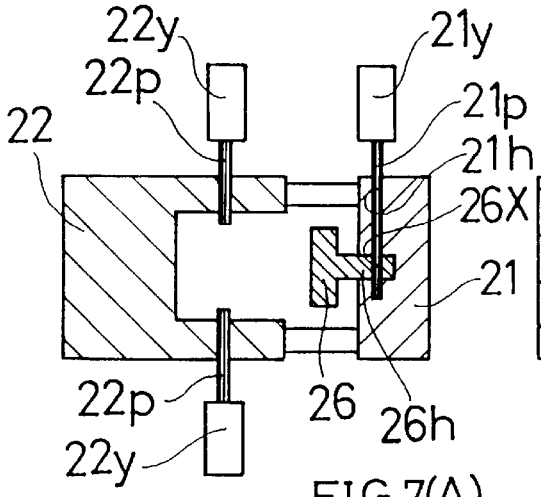
FIGS. 7(A) to 7(F) are views showing the steps of a casting method according to the second embodiment of the invention.
Figure 7B:
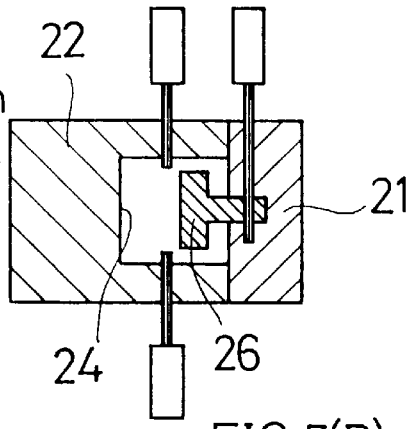
Figure 7C:
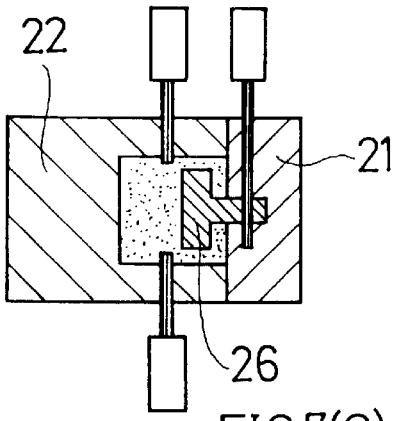

First, in the open state of the die, as shown in FIG. 7(A), the core print 26*h* of the resin core 26 is engaged in the core support section 21*s* of the stationary die half 21, and the core set pin 21*p* is inserted through the coupling holes 21*h* and the through hole 26*x*. As a result, the resin core 26 is positioned in the stationary die half 21 at a predetermined position thereof. Further, the cast product set pins 22*p* of the movable die half 22 are driven by the oil hydraulic piston-cylinder assemblies 22*y* so that their ends are projected into the cavity 24 noted above. In this state, the die is closed as shown in FIG. 7(B), and then molten metal is poured into the die as shown in FIG. 7(C).

Figure 7D:
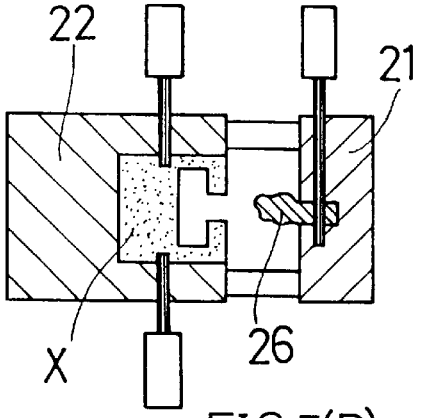

When the molten metal in the die has been solidified, the die is opened. The die is opened after the portion of the molten metal in contact with the die and the resin core has been solidified (instant T1 in FIG. 2) and before melting of the resin core (instant T2 in FIG. 2). Since the poured molten metal is solidified while surrounding the end portions of the cast product set pins 22p projecting from the movable die half 22 into the cavity 24, after the opening of the die, the cast product X is held secured to and moved together with the movable die half 22. Meanwhile, when the die is opened, the resin core 26 has been softened, that is, its average mechanical strength has been reduced, so that it is ready to be withdrawn. Thus, with the movement of the movable die half 22 caused together with the cast product X, the resin core 26 is withdrawn from the cast product X to remain on the side of the stationary die half 21, as shown in FIG. 7(D).

Figure 7E:
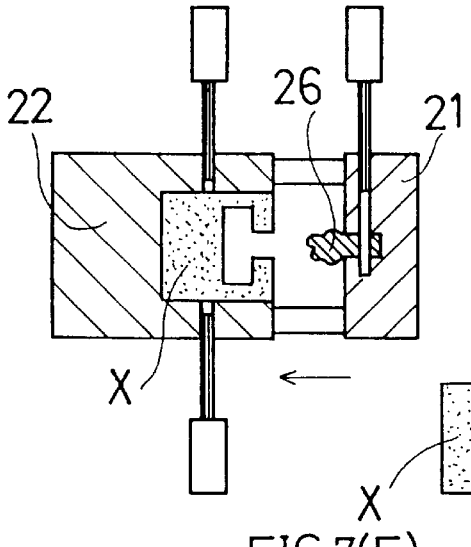
Figure 7F:
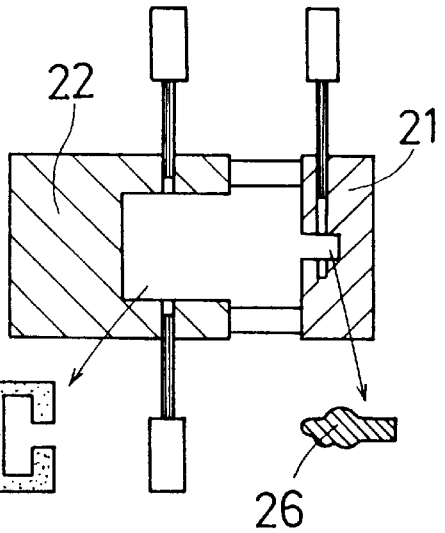

When the resin core 26 has been withdrawn from the cast product X, as shown in FIG. 7(E), the ends of the cast product set pins 22*p* are withdrawn from the cast product X and accommodated in the vertical through holes 22*h* of the movable die half 22 while the core set pin 21*p* is pulled out from the through hole 26*x* of the resin core 26. Thus, as shown in FIG. 7(F), the cast product X and the resin core 26 are taken out from the respective movable and stationary die halves 22 and 21.

As described, with the method of casting in this embodiment, the resin core 26 is withdrawn from the cast product by the force of opening the die halves 21 and 22. Thus, there is no need of any special drive power source for withdrawing the resin core 26, and it is thus possible to simplify equipment and reduce equipment cost.

While in this embodiment, the cast product set pins 22*p* are used to secure the cast product X to the movable die half 22, they may be replaced with pressurizing pins or the like.

(Third Embodiment)

Figure 8:
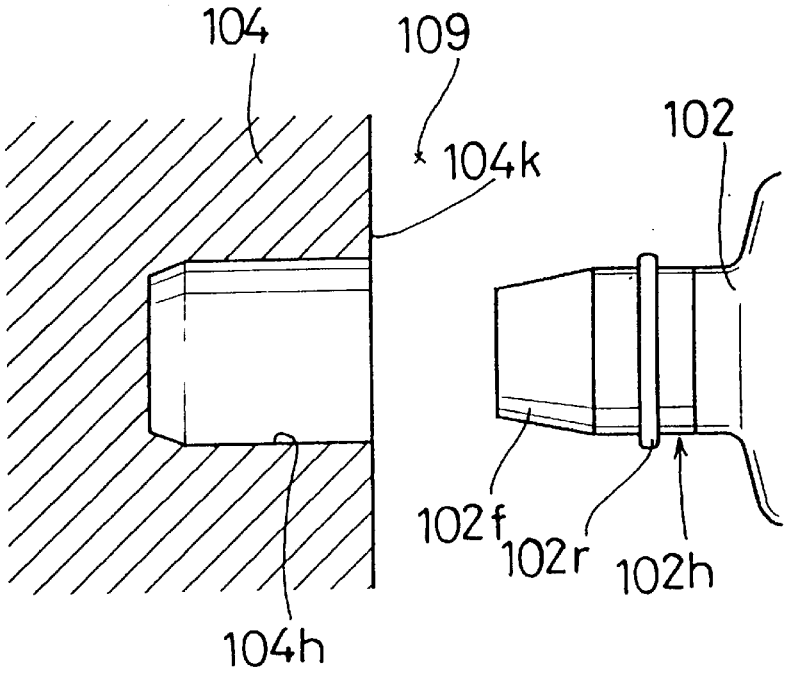
FIG. 8 is a side view showing a core print of a resin core and a recess in a casting die in which the core print is pressure fitted in a method of holding the resin core in a third embodiment of the invention.
Figure 9:
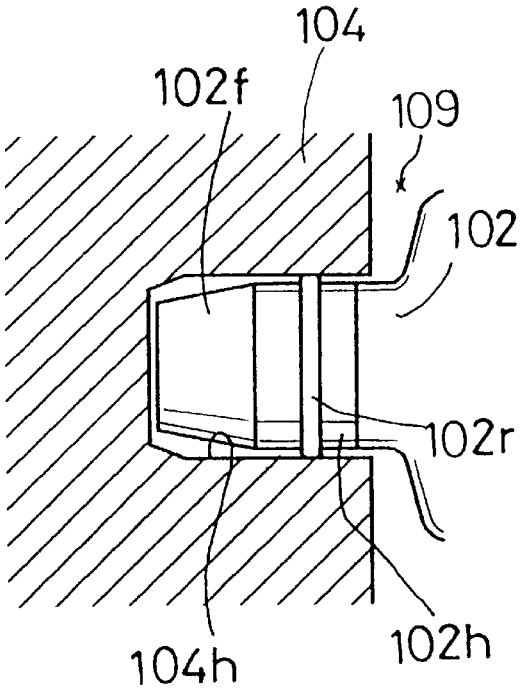
FIG. 9 is a side view showing the core print of the resin core pressure fitted in the recess of the casting die according to the third embodiment of the invention.

Now, a casting technique according to a third embodiment of the invention will be described with reference to FIGS. 8 and 9. This technique concerns an improved method of holding the resin core. Referring to the drawings, designated at 104 is a stationary die half. A movable die half (not shown) is moved to the left and the right in the plane of the drawings. When the movable die half is opened to the right in the drawings, the cast product is moved together with the movable die half relative to the stationary die half 104. FIG. 8 is a side view showing a core print 102*h* of a resin core 102 and a recess 104*h* in the stationary die half 104 into which the core print 102*h* is pressure fitted. FIG. 9 shows a state in which the core print 102*h* of the resin core 102 is pressure fitted in the recess 104*h* of the stationary die half 104.

The resin core 102 is used in a die casting process of producing a cast product by pouring high pressure molten metal into a cavity 109 in the die. The resin core 102 is made of polycarbonate or like synthetic resin having a high glass transition point as well as being high both in impact strength and ductility.

As shown in FIG. 8, the resin core 102 has its core print 102*h* for setting it in the die half 104. The core print 102*h* is a substantially cylindrical projection having a tapered frust-conical end portion 102*f*. The core print 102*h* has a circumferential ring-like ridge 102*r* formed in its axially intermediate portion.

Meanwhile, the recess 104h into which the core print 102*h* is pressure fitted is formed at a predetermined position of product formation surface 104*k* of the die half 104. The recess 104*h* is of a substantially cylindrical shape which is substantially complementary to the shape of the core print 102*h*. Its diameter is slightly smaller than the outer diameter of the ridge 102*r* of the core print 102*h*. It is set to be greater than the outer shape of the core print 102*h* such as to define a predetermined clearance.

As shown in FIG. 9, the resin core 102 is set in the die by pressure fitting its core print 102*h* into the recess 104*h* of the die half 104. Since the core print 102*h* has the tapered and frustconical end portion 102*f*, it can be smoothly led into the recess 104*h* of the die half 104. At this time, the ridge 102*r* formed on the core print 102*h* of the resin core 102 is squeezed from around by the side wall of the recess 104*h* formed in the die half 104, so that the core print 102*h* is firmly coupled to the die half 104 by the elastic force of the ridge 102*r*. Thus, it is possible to dispense with adhesive or the like that is used in the prior art to secure the resin core 102 to the die half 104. Further, the resin core 102 is automatically positioned in the cavity 109 at a predetermined position thereof when the die is closed with the resin core 102 secured to the die half 104.

To use the resin core 102 for casting, the core print 102*h* thereof is pressure fitted in the recess 104*h* of the die half 104 in the open state of the die as described above. The resin core 102 is thus firmly secured to the die half 104, and it is positioned in the cavity 109 at a predetermined position thereof with the closing of the die. When the die is closed, molten metal is poured under pressure into the cavity 109 from a plunger sleeve (not shown) through a plunger tip (not shown). At this time, polycarbonate as the material of the resin core 102 is such that its deformation is such as to maintain a mechanical strength enough to satisfy the shape accuracy required for the cast product against the high pressure and high heat of molten metal poured into the cavity 109 until molten metal in contact with the resin core 102 is solidified. Thus, the resin core 102 is not deformed beyond the shape accuracy required for the cast product with application of high temperature and high pressure thereto.

After the molten metal in contact with the resin core 102 has been solidified, polycarbonate as the material of the resin core 102 is gradually softened from the core surface in contact with the molten metal, and until the instant of opening the die, it is softened to an extent that it can be withdrawn from the cast product. Meanwhile, the core print 102*h* of the resin core 102 does not receive high pressure or high temperature of molten metal because it is engaged in the recess 104*h* of the die half 104. Thus, although the essential part of the resin core 102 enclosed in molten metal is softened by high heat thereof, the core print 102*h* is not softened, and the firm coupling between the resin core 102 and the die half 104 is maintained. Thus, with relative movement of the die half 104 to the cast product that is caused when the die is opened after the cast product has been formed with complete solidification of the molten metal in the cavity 109, the essential part of the softened resin core 102 is automatically withdrawn from the cast product. Further, only the cast product is taken out from the die to be transported to the next process. After the resin core 102 has been withdrawn from the cast product, the core print 102*h* of the resin core 102 can be readily removed from the recess 104*h* of the die half 104 by thermally softening it.

Figure 10:
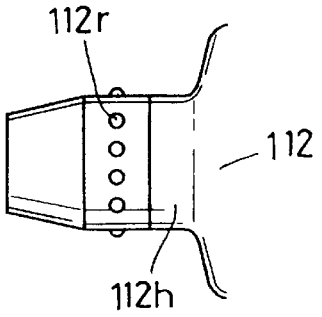
FIG. 10 is a side view showing a different example of the core print of the resin core.

FIG. 10 shows a different example of a core print 112*h* of a resin core 112. In this case, the core print 112*h* is provided with a plurality of semi-spherical protuberances 112*r* in lieu of the ridge 102*r*. These protuberances 112*r* have substantially the same function as the ridge 102*r* in the third embodiment.

(Fourth Embodiment)

Figure 11:
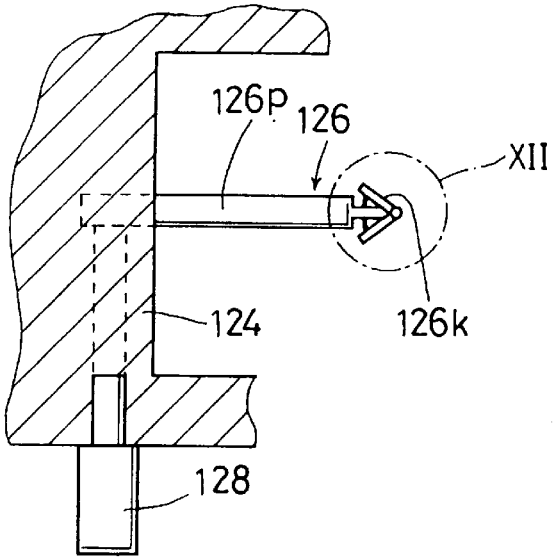
FIG. 11 is a side view showing a set pin used in a method of holding a resin core in a fourth embodiment of the invention.
Figure 12:
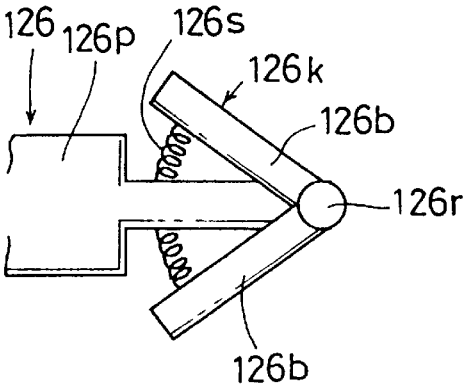
FIG. 12 is a detailed view showing a portion XII in FIG. 11.
Figure 13:
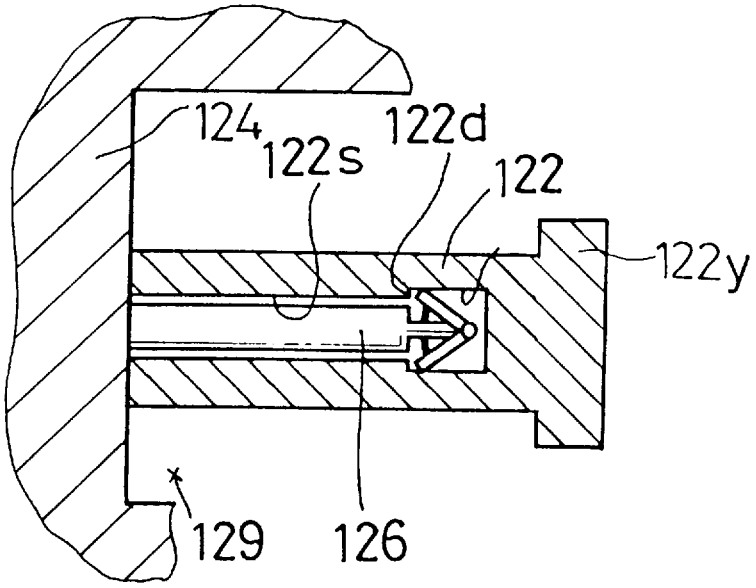
FIG. 13 is a sectional view showing the resin core mounted on the set pin used in the method of holding the resin core in the fourth embodiment of the invention.

Now, a method of holding a resin core in a fourth embodiment of the invention will be described with reference to FIGS. 11 to 13. FIG. 11 is a side view showing a set pin 126 for securing a resin core 122 to a die 124. FIG. 12 is a detailed view showing a portion XII of the set pin 126. FIG. 13 is a view showing a state in which the resin core 122 is mounted on the set pin 126.

The resin core 122 used in this embodiment, like the third embodiment, is formed by using polycarbonate or like synthetic resin. As shown in FIG. 13, it has an axial bore having a small and a large diameter coaxial bore 122s and 122*y* formed continuously to each other via a shoulder 122*d*.

The set pin 126 includes a pin body 126*p* and an openable mechanism 126*k* provided at an end of the pin body 126*p*. As shown in FIG. 11, the pin body 126*p* has its stem locked in engagement with the die 124 by a locking piston-cylinder assembly 128. The set pin 126 is thus firmly secured to the die 124. As shown in FIG. 12, the openable mechanism 126k provided at the end of the pin body 126*p* includes two openable members 126*b* hinged at one end by a hinge 126*r* to a V-shaped form and a spring 126*s* biasing the two openable members 126*b* away from each other for varying the angle therebetween. When the openable members 126*b* are folded against the spring force of the spring 126*s*, the outer diameter of the openable mechanism 126*k* is substantially equal to the outer diameter of the pin body 126*p*.

The outer diameter of the pin body 126*p* is set to be slightly smaller than the diameter of the small diameter hole 122*s* of the resin core 122. Thus, in the folded state of the openable mechanism 126*k*, it can be inserted together with the pin body 126*p* through the small diameter hole 122*s* of the resin core 122. When the openable mechanism 122*k* inserted through the small diameter hole 122*s* reaches the large diameter hole 122*y* of the resin core 122, the two openable members 126*b* are opened, i.e., brought away from each other, by the spring force of the spring 126*s*, and their ends are hooked on the step 122*d* of the resin core 122. In this way, the set pin 126 and the resin core 122 are coupled together. With the set pin 126 secured to the die 124, the distance from the die 124 to the openable mechanism 126*k* is substantially equal to the length of the small diameter hole 122*s* of the resin core 122, i.e., the distance from the end face of the resin core 122 to the step 122*d* thereof. When the openable mechanism 126*k* of the set pin 126 secured to the die 124 is hooked on the step 122*d* of the resin core 122 as a result of the fitting thereof on the set pin 126 as shown in FIG. 13, the resin core 122 is firmly coupled to the die 124 via the set pin 126 and is positioned in the die 124 at a predetermined position thereof such that its axial movement is restricted. Thus, unlike the prior art, there is no need of any adhesive for securing the resin core 122 to the die 124.

Since polycarbonate as the material of the resin core 122 has low heat conductivity, the high heat of molten metal is hardly conducted to the inside of the resin core 122. Thus, even when the surface of the resin core 122 in contact with molten metal is softened by the heat of molten metal, the inside of the resin core 122 is not softened but has a predetermined mechanical strength until the die is opened. That is, the resin core 122 and the die 124 are held firmly coupled together, and when the die 124 is opened, the resin core 122 is automatically withdrawn from the cast product with movement of the die 124 caused relative to the cast product toward left in the plane of the drawing. After the resin core 122 has been withdrawn from the cast product, the resin core 122 can be readily taken out from the set pin 126 by causing further thermal softening of the resin core 122 to soften the inside thereof.

(Fifth Embodiment)

Figure 14A:
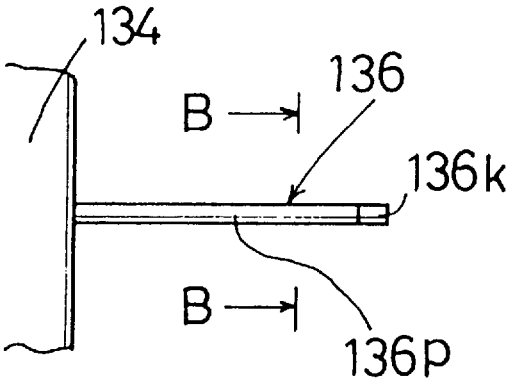
FIGS. 14(A) and 14(B) are a sectional view and a view taken in the direction of arrows B in FIG. 14(A), respectively, showing a set pin used in a method of holding resin core in a fifth embodiment of the invention.
Figure 14B:
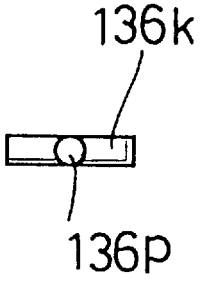
Figure 15A:
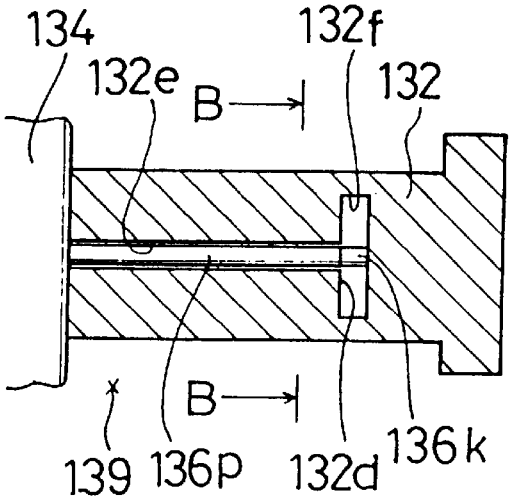
FIGS. 15(A) and 15(B) are a sectional view and a view taken in the direction of arrows B in FIG. 15(A), respectively, showing a resin core mounted on the set pin used in the method of holding the resin core in the fifth embodiment of the invention.
Figure 15B:
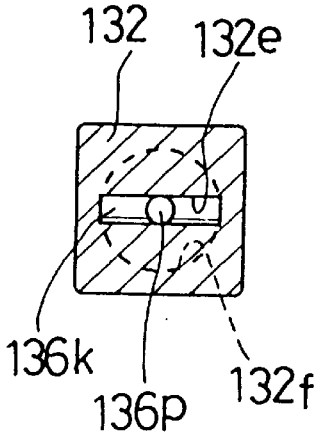

Now, a method of holding resin core in a fifth embodiment of the invention will be described with reference to FIGS. 14(A), 14(B), 15(A) and 15(B). FIG. 14(A) is a side view showing a set pin 136 for securing a resin core 132 to a die 134, and FIG. 14(B) is a view taken in the direction of arrows B in FIG. 14(A). FIG. 15(A) is a sectional view showing a state in which the resin core 132 is mounted on the set pin 136, and FIG. 15(B) is a view taken in the direction of arrows B in FIG. 15(A).

As in the preceding fourth embodiment, the resin core 132 used in this embodiment is formed by using polycarbonate or like synthetic resin. As shown in FIGS. 15(A) and 15(B), the resin core 132 centrally has a narrow rectangular hole 132*e* and a circular hole 132*f* having a diameter equal to the width of the rectangular hole 132*e* which are formed continuously to each other via a step or shoulder 132*d*.

The set pin 136 is substantially T-shaped and has a pin body 136*p* and a hook 136*k* secured perpendicularly to the end of the pin body 136*p*. The pin body 136*p* has a stem locked by a locking piston-cylinder assembly (not shown) in a state engaged in the die 134. The set pin 136 is thus firmly secured to the die 134.

The width and the length of the hook 136*k* of the pin body 136 are set to be slightly smaller than the height and the width, respectively, of the rectangular hole 132*e* of the resin core 132, so that the hook 136*k* can be inserted through the rectangular hole 132*e*.

The hook 136*k* having been inserted through the rectangular hole 132*e* into the circular hole 132*f* of the resin core 132 is hooked on the step 132*d* between the rectangular hole 132*e* and the circular hole 132*f* by causing rotation of the resin core 132 by about 90 degrees about the pin body 136*p*. In this way, the set pin 136 and the resin core 132 are coupled together. With the set pin 136 secured to the die 134, the length of the set pin 136, i.e., the pin body 136*p* and the hook 136*k*, projecting from the die 134, is substantially equal to the total length of the rectangular hole 132*e* and the circular hole 132*f* of the resin core 132. With this construction, by fitting the resin core 132 to the set pin 136 and rotating the resin core 132 about 90 degrees around the set pin 136 secured to the die 134, the resin core 132 is firmly coupled to the die 134 via the set pin 136 and is positioned in the die 134 at a predetermined position thereof with its axial movement restricted. Thus, unlike the prior art, there is no need of any adhesive or the like for securing the resin core 132 to the die 134.

Again in this embodiment, like the fourth embodiment, despite the softening of the surface of the resin core 132 in contact with molten metal caused by the heat of molten metal, the inside of the resin core 132 is not softened but has a predetermined mechanical strength until the die is opened. The resin core 132 and the die 134 are thus held firmly coupled together, and when the die 134 is opened, the resin core 132 is automatically withdrawn from the cast product with movement of the die 134 caused relative to the cast product.

After the resin core 132 has been withdrawn from the cast product, it can be removed from the set pin 136 by withdrawing it after turning it by 90 degrees. Thus, there is no need of heating the resin core 132 again for withdrawing it.

(Sixth Embodiment)

Figure 16A:
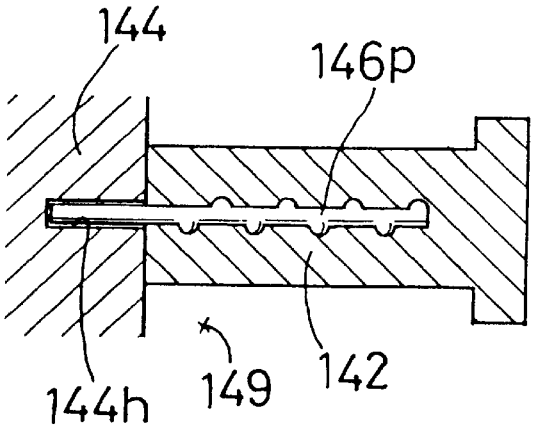
FIGS. 16(A) and 16(B) are sectional views showing a resin core mounted in a die and the resin core itself, respectively, in a method of holding the resin core in a sixth embodiment of the invention.
Figure 16B:
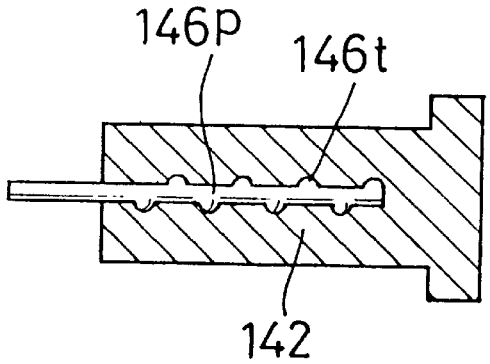

Now, a method of holding a resin core in a sixth embodiment will be described with reference to FIGS. 16(A) and 16(B). FIG. 16(A) is a sectional view showing a die 144 and a resin core 142 secured thereto by a set pin 146*p*, and FIG. 16(B) is a sectional view showing the resin core 142 and the set pin 146*p* alone.

The resin core 142 used in this embodiment is formed by injection molding polycarbonate or like synthetic resin into the predetermined shape such as to enclose the essential part of a set pin 146*p*. The resin core 142 and the set pin 146*p* are made integral. The set pin 146p which is buried in the resin core 142 has its essential portion formed with a helical ridge 146*t* therearound to prevent detachment of the set pin 146*p* from the resin core 142. Further, one end portion of the set pin 146*p* projecting from the end face of the resin core 142 serves as a core print of the resin core 142.

Meanwhile, the die 144 is formed at a predetermined position thereof with a recess 144*h* in which the set pin 146*p* as the core print of the resin core 142 is engaged. With the set pin 146*p* locked by a locking piston-cylinder assembly (not shown) in a state engaged in the recess 144*h*, the resin core 142 is firmly secured to the die 144 via the set pin 146*p* and positioned in the die 144 at a predetermined position thereof. Thus, unlike the prior art, there is no need of any adhesive or the like for securing the resin core 142 to the die 144.

Further, as in the fourth and fifth embodiments, when the surface of the resin core 142 in contact with molten metal is softened by the heat of the molten metal, the inner portion of the resin core 142 is not softened but still has a predetermined mechanical strength. Thus, the resin core 142 and the set pin 146*p* are held firmly coupled to the die 144, and when the die 144 is opened, the resin core 142 is automatically withdrawn from the cast product with movement of the die 144 caused relative to the cast product.

In this embodiment, the resin core 142 having been withdrawn from the cast product is taken out from the die 144 by releasing the lock by the locking piston-cylinder assembly and then taking out the set pin 146p from the recess 144*h* of the die 144.

(Seventh Embodiment)

Figure 17:
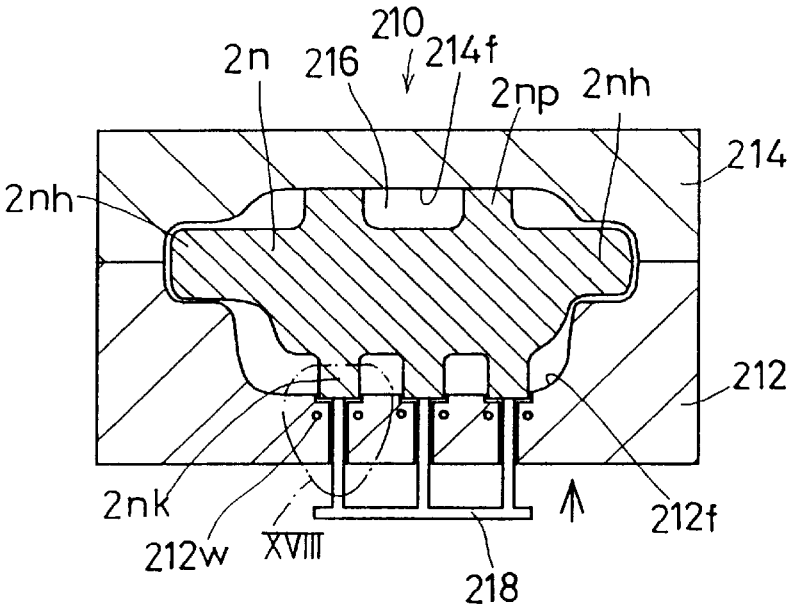
FIG. 17 is a sectional view showing a casting apparatus according to a seventh embodiment of the invention.
Figure 18:
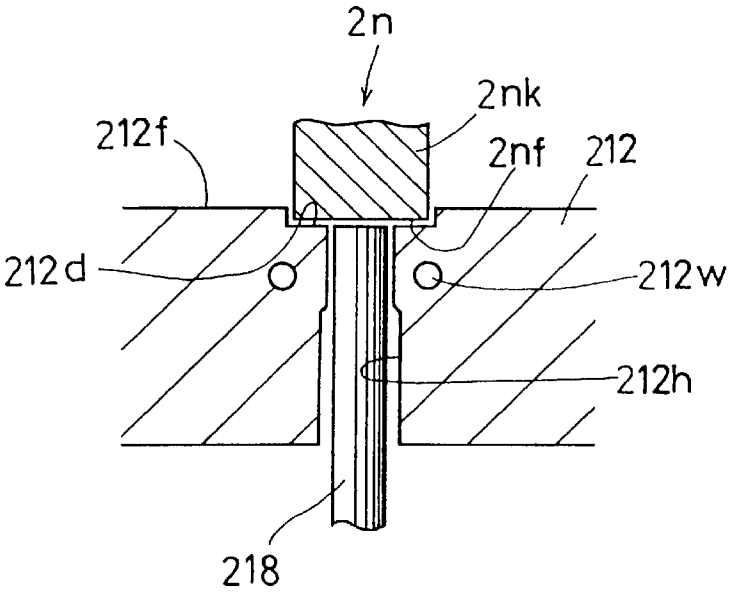
FIG. 18 is a detailed view showing a portion XVIII in FIG. 17.

A casting technique according to a seventh embodiment of the invention will now be described with reference to FIGS. 17 and 18. In this embodiment, the step of taking out cast product from the die is improved. FIG. 17 is a sectional view showing a casting apparatus 210 according to this embodiment. FIG. 18 is a detailed view showing a portion XVIII in FIG. 17.

The casting apparatus 210 comprises a stationary die half 212 and a movable die half 214. In the closed state of the die as shown in FIG. 17, a cavity 216 for forming a cast product is formed in the die. In the cavity 216, a resin core 2*n* is positioned at a predetermined position to form a hollow inner space in the cast product.

The resin core 2*n* has a core print 2*nh* which is to be located in a narrow space defined between the stationary die half 212 and the movable die half 214 so as to position the resin core 2*n* in the die. The resin core 2*n* has small diameter protuberances 2*nk* formed on its bottom side such as to be in contact with a forming surface 212*f* of the stationary die half 212. Further, it has large diameter protuberances 2*np* formed on its top side such as to be in contact with a forming surface 214*f* of the movable die half 214. As the material of the resin core 2*n*, polycarbonate or like synthetic resin which has a high glass transition point as well as being high in both the impact strength and ductility is suitably used.

The forming surface 212*f* of the stationary die half 212, as shown in FIG. 18, is provided with recesses 212*d*. Each recess 212*d* is formed to be in contact with each small protuberance 2*nk* of the resin core 2*n*. The end of the small protuberance 2*nk* is engaged in the recess 212*d*. A through hole 212*h* is formed such that it extends from the center of the recess 212*d* in the die closing direction (i.e., vertical direction in the drawing). A push-out pin 218 is slidably inserted in the through hole 212*h*. When the push-out pins 218 are projected from the forming surface 212*f* of the stationary die half 212 by a push-out mechanism (not shown), they push out the end of the small diameter protuberances 2*nk* (hereinafter referred to as push-out pin receiving sections) of the resin core 212 away from the stationary die half 212.

Each through hole 212*h* serves as a guide portion for positioning the corresponding push-out pin 218 from the side of the forming surface 212*f*. In this portion of the die, a small clearance is set between the stationary die half 212 and the push-out pin 218. Under the guide portion, a comparatively large clearance is set between the stationary die half 212 and the push-out pin 218 to prevent catching of the push-out pin 218 or the like.

The stationary die half 212 further has cooling water passages 212*w* formed in its walls surrounding the through holes 212*h* to cool end portions of the push-out pins 218 and recesses 212*d* in the forming surface 212*f* as well as peripheral portions. Thus, the push-out pin receiving sections 2*nf* of the resin core 2*n* engaged in the recesses 212*d* of the forming surface 212*f* are cooled effectively. Besides, because the heat conductivity of polycarbonate as the material of the resin core 2*n* is low, it is difficult for the heat of molten metal to be conducted through the body of the resin core 2*n* up to the push-pin receiving sections 2*nf*. Thus, the push-pin receiving sections 2*nf* are not suddenly elevated in temperature during casting, and they are not softened but have substantially the same mechanical strength as before the casting when the die is opened.

Further, the clearance between each small diameter protuberance 2*nk* of the resin core 2*n* and the associated recess 212*d* of the forming surface 212*f* when the protuberance 2*nk* and the recess 212*d* are in engagement with each other is set to be small. Further, the recesses 212*d* of the forming surface 212*f* and their peripheries are cooled to promote solidification of molten metal. Thus, it is difficult for molten metal to enter the clearance between each push-out pin receiving section 2*nf* of the resin core 2*n* and the associated recess 212*d* of the forming surface 212*f*. It is thus possible to suppress generation of burrs.

A method of taking out cast product according to this embodiment will now be described.

First, in the open state of the die, the resin core 2*n* is set in the stationary die half 212 such that each small diameter protuberance 2*nk* of the resin core 2*n* is engaged in the associated recess 212*d* of the stationary die half 212. In this state, the die is closed by causing movement of the movable die half 214. When the die closing has been completed, as shown in FIG. 17, molten metal is poured under pressure into cavity 216 through a plunger sleeve (not shown). When the poured molten metal is solidified after lapse of a predetermined period of time, the die is opened, and the push-pin receiving sections 2*nf* of the resin core 2*n* are pushed by the push-out pins 218. As described before, when the die is opened after completion of casting, the push-out pin receiving sections 2*nf* of the resin core 2*n* are held such that both their impact strength and ductility are high. Thus, the cast product can be reliably kicked out from the stationary die half 212 without deformation of the push-out pin receiving sections 2*nf* by receiving the pushing forces of the push-out pins 218.

The resin core 2*n* is made of a resin, and it can be readily withdrawn from the cast product by causing its thermal softening after the cast product has been taken out from the die.

As has been shown, in this embodiment, unlike the prior art, there is no need of providing pin seats on the cast product surface for receiving each push-out pins 218, nor is there any need of operation of scraping out the pin seats in a subsequent step. It is thus possible to obtain cost reduction and improve the operation efficiency.

(Modification of Seventh Embodiment)

Figure 19:
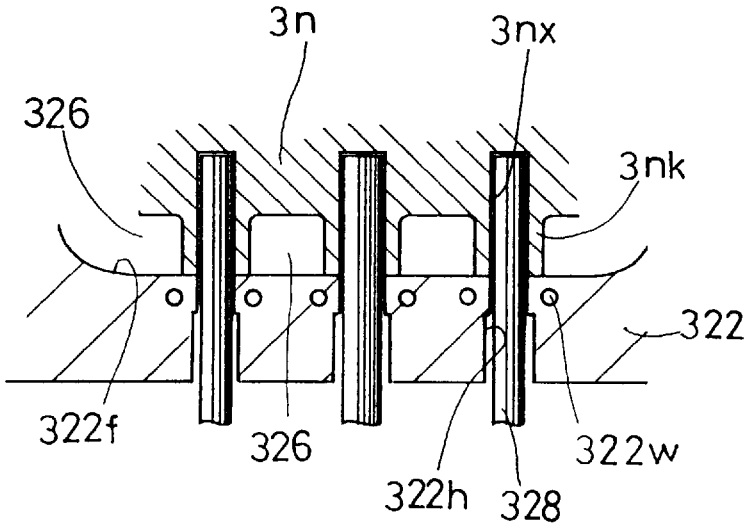
FIG. 19 is a fragmentary sectional view showing a casting apparatus according to a modification of the seventh embodiment of the invention.
Figure 20:
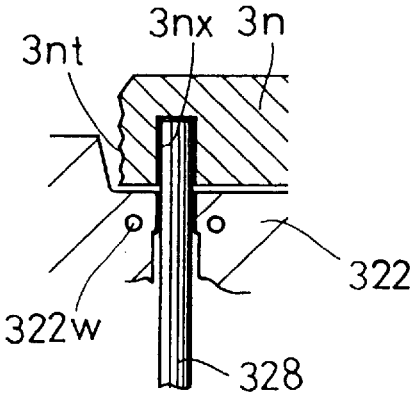
FIG. 20 is a fragmentary sectional view illustrating the way of taking out a cast product in the modification of the seventh embodiment of the invention.

A method of taking out cast product according to a modification of the seventh embodiment will now be described with reference to FIGS. 19 and 20. FIG. 19 is a fragmentary sectional view showing a casting apparatus according to this embodiment. FIG. 20 is a fragmentary sectional view illustrating an application example of the cast product take-out method according to this embodiment.

This embodiment uses a resin core 3*n* which is obtained by forming each small diameter protuberance 3*nk* of the resin core used in the seventh embodiment with a recess 3*nx* in which each push-out pin 328 is engaged. Thus, when setting the resin core 3*n* in the cavity 326 of the die, it can be positioned in a prescribed position with the engagement between its recesses 3*nx* and push-out pins 328.

The method of taking out the cast product according to this embodiment will now be described.

First, in the open state of the die, the resin core 3*n* is set in the stationary die half 322 such that its recesses 3*nx* are engaged with the push-out pins 328 projecting to a predetermined extent from a forming surface 322*f* of the stationary die half 322. In this state, the die is closed by causing movement of the movable die half (not shown). When the die closing has been completed, molten metal is poured under pressure into the cavity 326 through a plunger sleeve (not shown). When the poured molten metal is solidified after lapse of a predetermined period of time, the die is opened, and the resin core 3*n* is pushed out by the push-out pins 328. Thus, the cast product with the resin core 3*n* cast therein is kicked out and taken out from the stationary die half 322.

As shown above, in this embodiment, the resin core 3*n* is positioned in the cavity 326 at a predetermined position thereof with the engagement between the resin core 3*n* and the push-out pins 328. Thus, no core print or the like for positioning the resin core 3*n* relative to the die is necessary, thus permitting reduction of the cost of fabrication of the resin core 3*n*. In addition, in the construction as shown in FIG. 20 in which the resin core 3*n* has its periphery supported for positioning, unlike the prior art, it is not necessary to accurately form the peripheral surface 3*nt* of the resin core 3*n*, thus permitting reduction of the cost of fabrication.

(Eighth Embodiment)

Now, an eighth embodiment of the invention will be described with reference to FIGS. 21(A), 21(B) and 22.

First, the overall structure of a resin core of this embodiment will be described with reference to FIGS. 21(A) and 21(B). FIG. 21(A) is a front view showing a resin core 402 according to this embodiment and an example of a cast product 40W obtained by using the resin core 402. FIG. 21(B) is a sectional view showing the resin core 402.

Figure 21A:
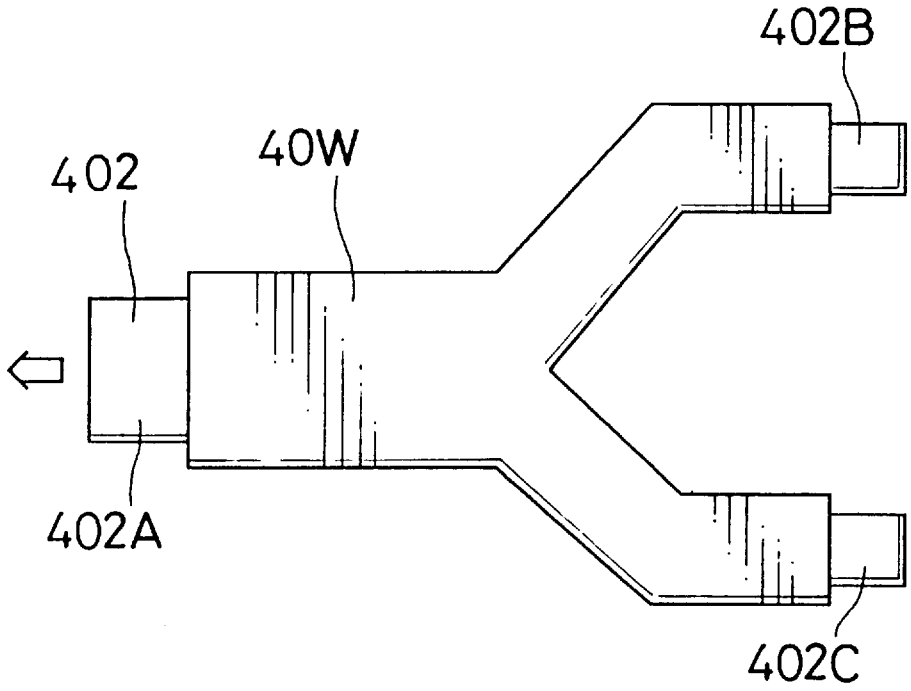
FIGS. 21(A) and 21(B) are sectional views showing an example of the resin core and the cast product obtained thereby and the structure of the resin core, respectively, according to an eighth embodiment of the invention.
Figure 21B:
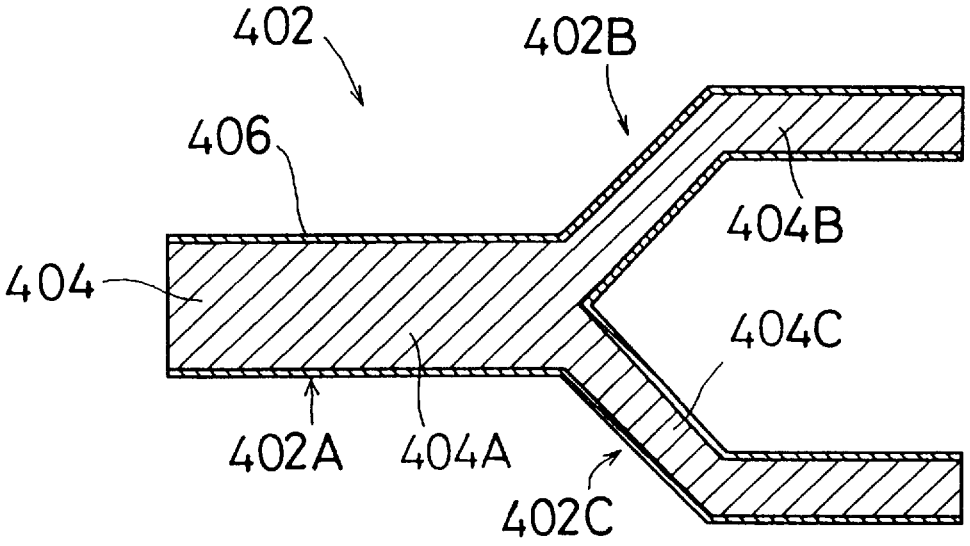

As shown in FIGS. 21(A) and 21(B), the resin core 402 in this embodiment is used to cast a Y-shaped hollow product 40W. The resin core 402 is also Y-shaped and has a stem portion 402A which is circular in sectional profile and two branch portions 402B and 402C also circular in cross section. This resin core 402 is set in a cavity (not shown), and then molten metal is poured thereinto. After the molten metal has been solidified as the cast product 40W, the resin core 402 is withdrawn to the left in FIG. 21(A) while undergoing plastic deformation.

The internal structure of the resin core 402 will now be described with reference to FIG. 21(B). As shown in the drawing, the resin core 402 comprises a resin core body 404 made of a polyethylene type resin and stainless steel foil 406 covering the surface of the resin core body 404. The stainless steel foil 406 is covering the surface of the circular stem portion 404A and also the surfaces of the two circular branch portions 404B and 404C. In this embodiment, two different foils, i.e., ferrite type stainless steel foil and austenite type stainless steel foil, are used as the stainless steel foil 406.

While in this embodiment, all the surfaces of the stem and branch portions 404A to 404C of the resin core body 404 are covered with the stainless steel foil 406, it is necessary to cover only a portion of the surfaces of the resin core body 404 which is to be in contact with molten metal, i.e., a portion enclosed in the cast product 40W, as shown in FIG. 21(A).

A method of fabricating such resin core 402 will now be described with reference to FIG. 22. FIG. 22 is a fragmentary transversal sectional view showing the internal structure of the resin core 402. That is, the drawing shows a section of the resin core 402 taken perpendicularly to the axis of the resin core 402.

Figure 22:
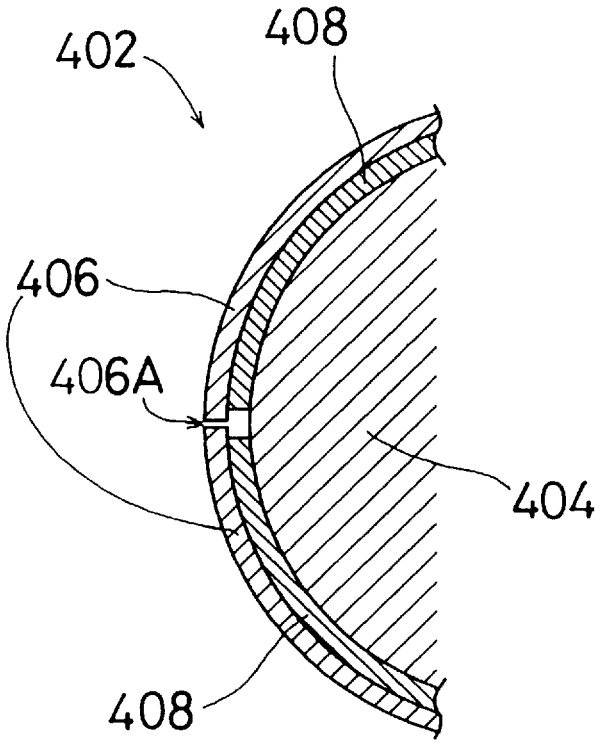
FIG. 22 is a fragmentary sectional view showing the internal structure of a resin core according to the eighth embodiment of the invention.

As shown in FIG. 22, the stainless steel foil 406 is applied by adhesive 408 to the surface of the circular resin core body 404. More specifically, the adhesive is first applied to a uniform thickness to the surface of the resin core body 404, and then the stainless steel foil 406 is wound on the adhesive coating. In this embodiment, the adhesive 408 is a cyanoacrylate type adhesive.

The wound stainless steel foil 406 has its edges 406A not quite abutted. By adopting this butt structure, a very small clearance is formed between the edges 406A, and elongation, strain, etc. of the material generated by the high temperature and high pressure during casting can be absorbed in this clearance.

The thickness of the stainless steel foil 406 can be suitably selected in dependence on the character of the resin used for the resin core body 404 and casting conditions such as the temperature of the molten metal and the casting pressure.

When the resin core body 404 is made of polyethylene and covered with ferrite type stainless steel foil, particularly satisfactory results could be obtained with the foil thickness set to about 50 to 200 $\mu$m in case when casting aluminum material "ADC10" (at a molten metal temperature of 730° C.) with a casting pressure of 80 MPa. When the resin core body 404 is made of a polyethylene type material and covered with austenite type stainless steel foil, particularly satisfactory results could be obtained with the foil thickness set to about 100 to 200 $\mu$m.

A method of casting using the resin core 402 having the above structure will now be described with reference to FIGS. 21(A) and 21(B). The resin core 402 is set in a cavity (not shown), and then molten metal is poured into the cavity.

The poured molten metal is brought into contact with the stainless steel foil 406 covering the surface of the resin core body 402 but is not brought into contact with the resin core body 404 itself. With this protection of the resin core body 404 from molten metal by the stainless steel foil 406, it is possible to prevent melting or deformation of the resin core body 404. Thus, until the poured molten metal is solidified, the resin core 402 is not deformed by the high temperature and high pressure of molten metal but reliably maintains a predetermined shape.

After the solidification of the molten metal, the resin core body 404 is continually elevated in temperature by residual heat, and, at a certain instant, it reaches the temperature of its softening. At this time, i.e., when the resin core body 404 is softened by residual heat after the solidification of the cast product 40W, the left end of the stem portion 402A of the resin core body 402 is held by core withdrawing means (not shown) and pulled to the left in FIG. 21(A). Thus, the branch portions 402B and 402C are elastically deformed, and the resin core body 404 is withdrawn from the left end of the cast product 40W. At this time, the stainless steel foil 406 is readily deformed.

It is thus possible to obtain higher accuracy casting without the possibility of melting or deformation of the resin core 402 that might otherwise be caused in contact with high temperature, high pressure molten metal.

While this embodiment has been described in relation to an example of using a polyethylene type resin as the material of the resin core body 404, it is possible as well to use various other resin materials including thermoplastic synthetic resins, such as polycarbonate, polypropylene, copolymers of these compounds and silicone resin, and natural resins such as wax. The adhesive 408 also is not limited to the cyanoacrylate type adhesives, but it is possible to use various other adhesives.

Further, while in the above embodiment, the austenite type and ferrite type stainless steel foils have been used as the stainless steel foil 406 covering the resin core body 404, it is possible to use any metal foil so long as it is not corroded by molten metal and not softened by the temperature of molten metal.

(Ninth Embodiment)

Figure 23:
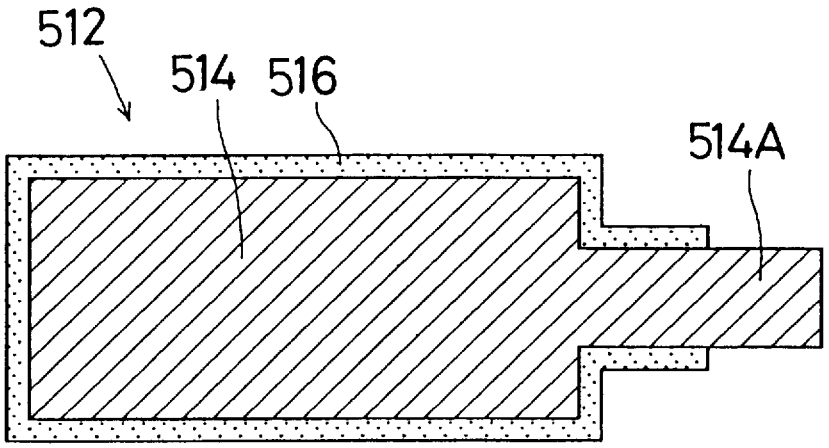
FIG. 23 is a sectional view showing a resin core used in a ninth embodiment of the invention.

Now, a ninth embodiment of the invention will be described with reference to FIG. 23.

First, the structure of a resin core of this embodiment will be described with reference to FIG. 23. FIG. 23 is a sectional view showing a resin core 512 according to this embodiment. As shown in the drawing, with the resin core 512 in this embodiment, a portion of a resin core body 514 that is to be in contact with molten metal in the cavity is covered with a ceramic layer 516.

The ceramic layer 516 may be made of various ceramic materials including oxide ceramics such as $Al_2O_3$, $SiO_2$ and $ZrO_2$, and non-oxide ceramics such as SiC, $Si_3N_4$, TiN and WC.

A method of forming the ceramic layer 516 will now be described. Fine ceramic particles of $Al_2O_3$, $SiO_2$, $ZrO_2$, etc. as noted above are mixed with a heat-resistant binder (viscous binder). The mixture is then coated uniformly to a predetermined thickness on the entire surface of the resin core body 514 exclusive of a core print 514A which is not in contact with molten metal. Subsequently, the coating is sufficiently dried, thus obtaining the resin core 512 shown in FIG. 23.

With the use of the resin core 512 having the above structure for casting, molten metal poured into the cavity is brought into contact with the ceramic layer 516 covering the surface of the resin core 512 but is not brought into contact with the resin core body 514 itself. Thus, the resin core body 514 which is protected from molten metal by the ceramic layer 516 is reliably prevented from melting or deformation.

Thus, until the poured molten metal is solidified, the resin core 512 is not deformed by the high temperature and high pressure of molten metal but reliably maintains its predetermined shape. The resin core 512 thus permits higher accuracy casting without the possibility of melting or deformation in contact with high temperature, high pressure molten metal, as well as being readily separable from the cast product.

As the material of the resin core body 514 in this embodiment, as in the eighth embodiment, various resins may be used, including thermoplastic synthetic resins such as polycarbonate, polyethylene, polypropylene, copolymers of these compounds and silicone resin, thermosetting synthetic resins, and natural resins such as wax.

While in this embodiment, the ceramic layer 516 has been formed by coating fine ceramic particles together with a heat-resistant binder on the resin core body 514, it is possible as well to adopt various other methods such as an injection method of forming a ceramic coating layer on the resin core surface.

Further, since in this embodiment fine ceramic particles are coated together with a heat-resistant binder on the resin core body 514 to form the ceramic layer 516, it is possible to obtain a particular effect that the surface of the ceramic layer 516 has minute irregularities due to the ceramic particles. These surface irregularities have an effect of breaking an oxide film formed on the leading end of poured molten metal, thus improving the wetting property of molten metal with respect to the resin core 512. With this wetting improvement, it is possible to extremely reduce cast product defectiveness such as wetting defectiveness and molten metal boundary defectiveness.

Further, the use of the heat-resistant binder for the surface layer, together with the hardness of the ceramic particles, has an advantage of further improving the breakdown pressure of the resin core 512.

(Tenth Embodiment)

Figure 24:
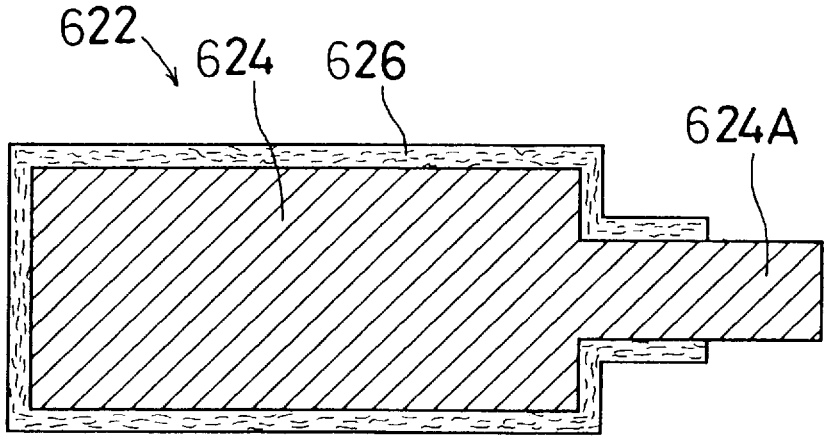
FIG. 24 is a sectional view showing a resin core used in a tenth embodiment of the invention.

Now, a tenth embodiment of the invention will be described with reference to FIG. 24.

The structure of a resin core of this embodiment will first be described with reference to FIG. 24. FIG. 24 is a sectional view showing a resin core 622 according to this embodiment. As shown in the drawing, with the resin core 622 in this embodiment, a portion of a resin core body 624 that is to be in contact with molten metal in cavity is covered with a heat-resistant fiber layer 626.

As the heat-resistant fibers may be used various fiber materials, including fibers of metals such as stainless steel, fibers of metal coating type, fibers of oxide ceramics such as $Al_2O_3$, $SiO_2$ and $ZrO_2$, and fibers of non-oxide ceramics such as SiC, $Si_3N_4$, TiN and WC.

A method of forming the heat-resistant fiber layer 626 will now be described. Heat-resistant fibers of one or more of the various kinds mentioned above are mixed with a heat-resistant binder. The mixture is then coated uniformly to a predetermined thickness on the entire surface of the resin core body 624 exclusive of a core print 624A which is not in contact with molten metal. Then, the coating is dried sufficiently, thus obtaining the resin core 622 as shown in FIG. 24.

With the use of the resin core 622 having the above structure for casting, the molten metal poured into the cavity is brought into contact with the heat-resistant fiber layer 626 covering the surface of the resin core 622 but is not brought into contact with the core print 624A. In this way, the resin core body 624 is protected from molten metal by the heat-resistant fiber layer 626 and is thus prevented from melting or deformation.

Thus, until the poured molten metal is solidified, the resin core 622 is not deformed by the high temperature and high pressure of the molten metal but reliably maintains its predetermined shape. The resin core thus permits higher accuracy casting without possibility of its melting or deformation in contact with the high temperature, high pressure molten metal, as well as being readily separable from the cast product. As in the eighth and ninth embodiments, various materials may be used for the material of the resin core 624 in this embodiment.

While in this embodiment the heat-resistant fiber layer 626 is formed by coating heat-resistant fibers together with a heat-resistant binder on the resin core body 624, it is possible as well to use other methods such as bonding heat-resistant fibers to the resin core body 624 by using a heat-resistant adhesive.

(Eleventh Embodiment)

Figure 25A:
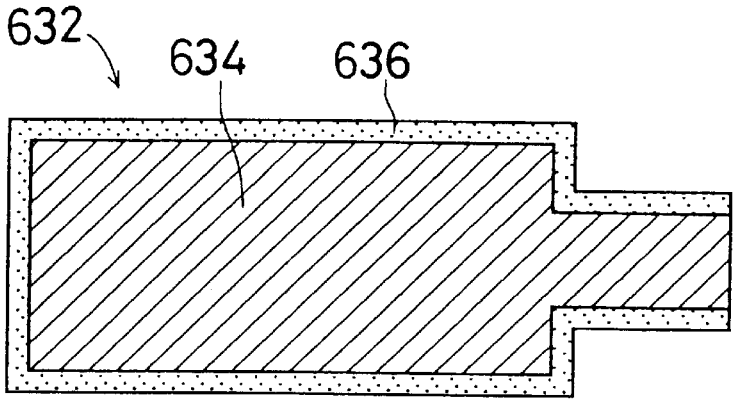
FIGS. 25(A) and 25(B) are sectional views showing a resin core used in an eleventh embodiment of the invention and a method of preparing the same resin core, respectively.

Now, an eleventh embodiment of the invention will be described with reference to FIGS. 25(A) and 25(B).

The structure of a resin core of this embodiment will first be described with reference to FIG. 25(A). FIG. 25(A) is a sectional view showing a resin core 632 in this embodiment.

As shown in the drawing, with the resin core 632 in this embodiment, a resin core body 634 is covered with a sand layer 636. As the sand of the sand layer 636, various kinds of sand such as sand for die formation and commonly termed shell sand with resin coating may be used.

A method of forming the sand layer 636 will now be described with reference to FIG. 25(B). FIG. 25(B) is a sectional view illustrating a method of fabricating the resin core 632 in this embodiment.

In this embodiment, shell sand is used for forming the sand layer 636, and this shell sand layer is coated on the inner wall surfaces of a die 630 for forming the resin core 632. For the coating of shell sand, a highly heat-resistant resin capable of being melted only at a high temperature is used.

The die 630 for forming the resin core 632 comprises an upper die half 630A and a lower die half 630B made of a metal. When these die halves 630A and 630B are closed together, the inner wall surfaces 631 of the die 630 define a cavity shape complementary to the outer shape of the resin core 632.

First, shell sand is fully charged into the die 630. Then, the entire die 630 is heated from the outside. As the temperature of the inner wall surfaces 631 of the die 630 is thus gradually increased, the coating resin on the shell sand is melted from the side of the portion of shell sand in contact with the inner wall surfaces 631, and the molten resin is attached to the inner wall surfaces 631. After the die 630 has been heated for a predetermined period of time, it is then cooled down. Afterwards, a central portion of shell sand which has not been attached to the inner wall surfaces 631 is discharged from the die 630.

In this way, a layer 636 of closely stacked shell sand having a predetermined thickness can be formed on the inner wall surfaces 631 of the die 630 by adequately controlling the temperature and time of heating of the die 630.

Figure 25B:
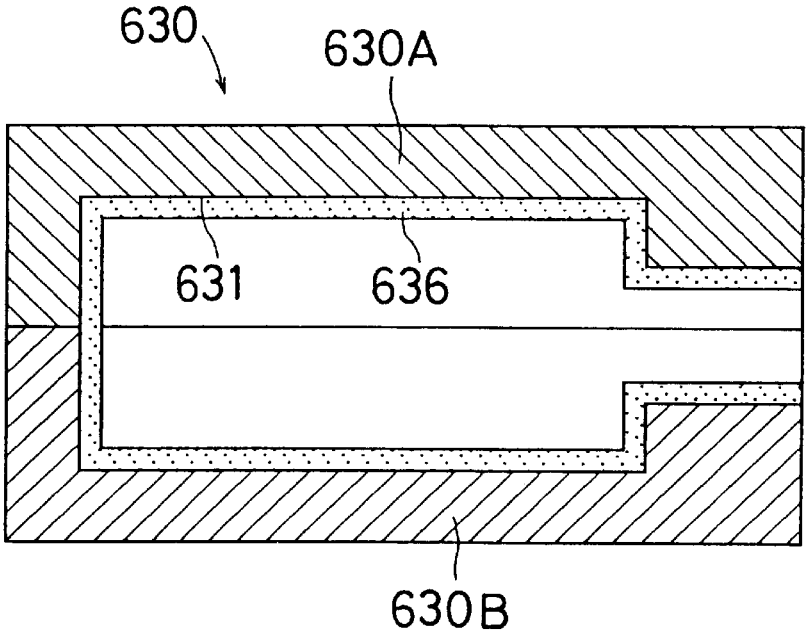

FIG. 25(B) shows the resultant die 630 into which molten resin material of the resin core body 634 is poured. After the poured resin has been solidified by cooling, the upper and lower die halves 630A and 630B are separated from each other, and the resin core 632 which comprises the shell sand layer 636 and the resin core body 634 is taken out.

The resin core 632 which is fabricated in this way is used for pressure casting such as die casting. Thus, molten metal poured into the cavity is brought into contact with the sand layer 636 constituting the surface of the resin core 632 but is not brought into contact with the resin core body 634. The resin core body 634 is thus protected from molten metal by the closely stacked sand layer 636 and is reliably prevented from melting or deformation.

Thus, until the molten metal is solidified, the resin core 632 is not deformed by the high temperature and high pressure of molten metal but reliably maintains a predetermined shape. It is thus possible to obtain a resin core which permit higher accuracy casting without possibility of melting or deformation as a result of contact with the high temperature, high pressure molten metal and which is readily separable from the cast product.

In this embodiment, as in the eighth to tenth embodiments, various resin materials may be used for the resin core body 634.

Further, while the sand layer 636 in this embodiment has been formed by heating shell sand charged into the core formation die 630 for a predetermined period of time, the sand layer 636 thus being attached with a predetermined thickness to the inner wall surfaces 630 and subsequently made integral with the poured molten resin material, it is possible to adopt other methods of formation as well. For example, with the upper and lower die halves 630A and 630B held separated from each other, a mixture of sand and a heat-resistant binder may be coated uniformly on the inner wall surfaces 631 and dried. Subsequently, the upper and lower die halves 630A and 630B are closed together, and the resin material is then poured and thus made integral with the sand layer 636.

With the sand layer 636 preliminarily attached to the inner wall surfaces 636 of the core formation die 630 in the above way, the outer shape dimensions of the fabricated resin core 632, i.e., the outer shape dimensions of the superficial sand layer 636, are in accord with the inner shape dimensions of the die 630. Thus, it is possible to fabricate the resin core very accurately.

As a further alternative method, first the resin core body 634 alone is formed through injection molding or like operation, and then a mixture of sand and a heat-resistant binder is coated uniformly on the surface of the resin core body 634. When the method of attaching the sand layer 636 afterwards in this way is adopted, the resin core body 634 should be formed to be smaller to an extent corresponding to the thickness of the sand layer 636.

(Twelfth Embodiment)

Now, a twelfth embodiment of the invention will be described with reference to FIGS. 26(A) to 26(C), 27(A), 27(B) and 28. This embodiment features that heat-resistant fibers are incorporated in resin core.

There has been a well-known technique of producing cast products with small thicknesses by using fiber-reinforced plastic (abbreviated as FRP) incorporating carbon fibers in epoxy type resin materials. However, there has been no well-known technique of producing a fiber-reinforced resin core with large thicknesses, adequate heat resistance, elasticity and mechanical strength.

Figure 26A:
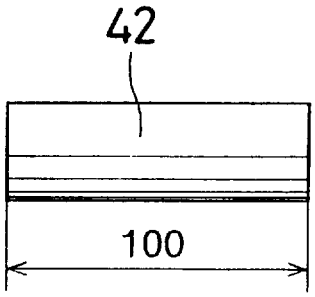
FIGS. 26(A) to 26(C) are views showing the shape and a characteristic, respectively, of a resin core in a twelfth embodiment of the invention.
Figure 26B:
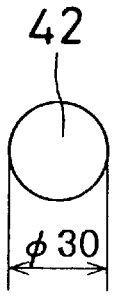
Figure 26C:
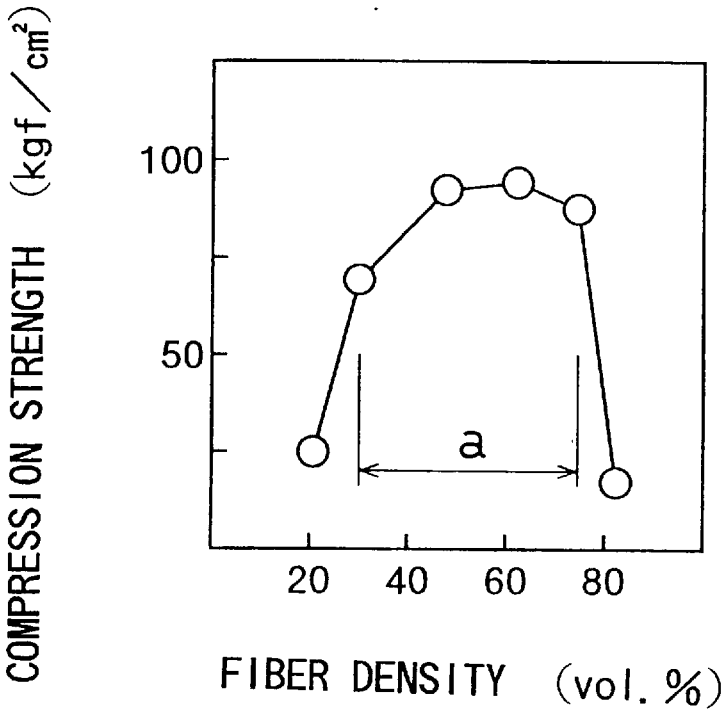
Figure 27A:
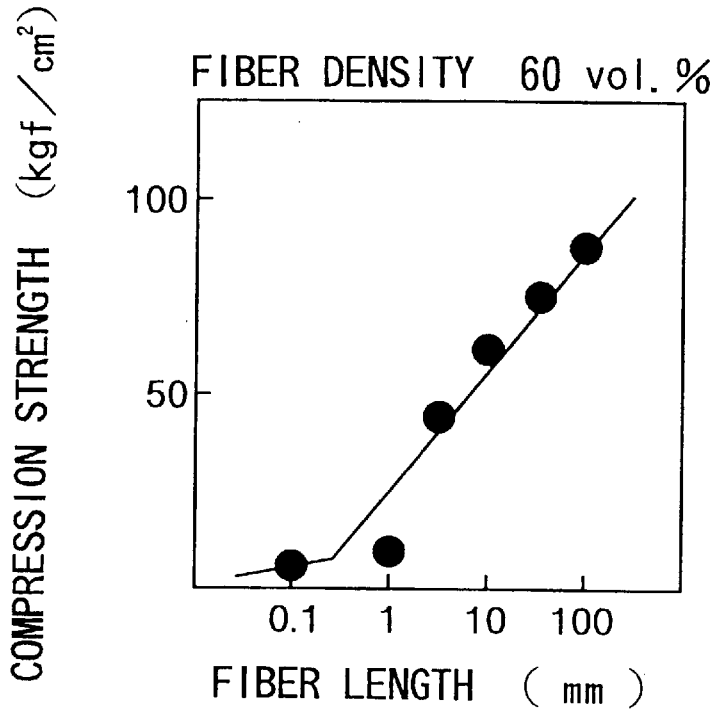
FIGS. 27(A) and 27(B) are graphs showing characteristics of the resin core in the twelfth embodiment of the invention.
Figure 27B:
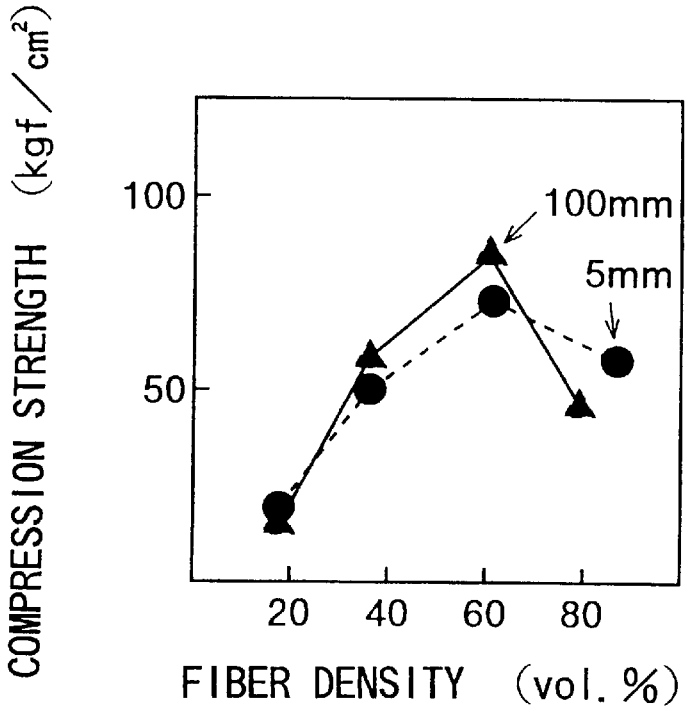

Accordingly, tests were conducted on conditions for obtaining the break-down pressure that is satisfactory for high pressure casting such as die casting with FRP using silicone type resin materials. The tests conducted will now be described with reference to FIGS. 26(A) to 26(C), 27(A) and 27(B). FIGS. 26(A) and 26(B) are a front view and a side view, respectively, showing the shape of resin core for the tests in this embodiment. FIGS. 26(C), 27(A) and 27(B) are graphs showing characteristics of the resin core in this embodiment.

Compression strength tests were conducted using the test piece of the shape as shown in FIGS. 6(B) and 26(B) under various conditions. As the resin material, silicone rubber was used. As the reinforcement fibers, $Al_2O_3$ fibers which are a variety of ceramic fibers were used.

First, tests were made in connection with the relation between the fiber density in the silicone rubber FRP, i.e., volume percentage of $Al_2O_3$ fibers in FRP, and the compression strength of the FRP. FIG. 26(C) shows the results. As the $Al_2O_3$ fibers, long fibers with lengths no less than 100 mm were used. Further, the injection molding process was adopted for molding the FRP.

It will be seen from FIG. 26(C) that the compression strength is reduced when the fiber density is excessively reduced and also excessively increased, that is, excellent compression strength is obtainable with fiber density of 30 to 75 vol.% as shown by a range a in the drawing.

Accordingly, a resin core was molded using silicone rubber FRP with fiber density in a range of 30 to 75 vol.% and was used in a casting test by aluminum die casting. In this test, satisfactory cast product could be obtained without deformation of the resin core.

Regarding the withdrawal of the resin core after casting, it is found that the resin core could be more readily withdrawn in the longitudinal direction of the $Al_2O_3$ fibers.

It will be seen that it is possible to obtain a resin core of silicone rubber FRP having excellent break-down pressure by using long $Al_2O_3$ fibers. However, when producing resin cores having more complicated shapes, for instance a resin core for a cast product having a complicated hollow shape such as the cylinder head of cylinder block of an automotive engine, there is a problem that by using long fibers, the molding is difficult.

Accordingly, to determine conditions to be met for using short $Al_2O_3$ fibers, tests were conducted in connection with the relation between the length of $Al_2O_3$ fibers and the compression strength. FIG. 27(A) shows the result. The fiber density was set to 60 vol.%, and the injection molding process was employed for molding the resin core.

It will be seen from FIG. 27(A) that the compression strength is improved with increasing fiber length. To determine the optimum fiber density in case of using short fibers, tests were conducted in connection with the relation between the fiber density and the compression strength in cases where fiber length was 5 and 100 mm. FIG. 27(B) shows the results. It will be seen from FIG. 27(B) that in case of using short fibers, the most excellent compression strength is obtainable with fiber density in a range of 50 to 70 vol.%.

Casting tests were conducted using a resin core having a complicated shape by collectively taking the above results of tests into considerations. An engine cylinder head was die cast by preparing a water jacket resin core using silicone rubber FRP. Resin cores which were fabricated under the conditions of a fiber length of about 10 to 100 mm and a fiber density of about 20 to 60 vol.%, permitted satisfactory cast products to be obtained. Moreover, the resin cores could be readily withdrawn after casting.

Resin cores obtained with a fiber density of 80 vol.% had sufficient compression strength and had no problem insofar as the heat resistance and pressure resistance during casting. However, their withdrawal after casting was difficult because their plastic deformation was not so much.

The above conditions are for resin cores having complicated shapes such as that for a water jacket. Resin cores having simple shapes, however, permit satisfactory cast products to be obtained under conditions deviated from the above conditions.

As shown, resin cores obtained by incorporating $Al_2O_3$ fibers in silicone rubber are very excellent in the breakdown pressure property and can withstand high pressure in pressure casting such as die casting. Thus, the dimensional accuracy of cast product is very satisfactory, and it is possible to obtain practical pressure casting, through which cast products having excellent quality can be obtained.

Figure 28:
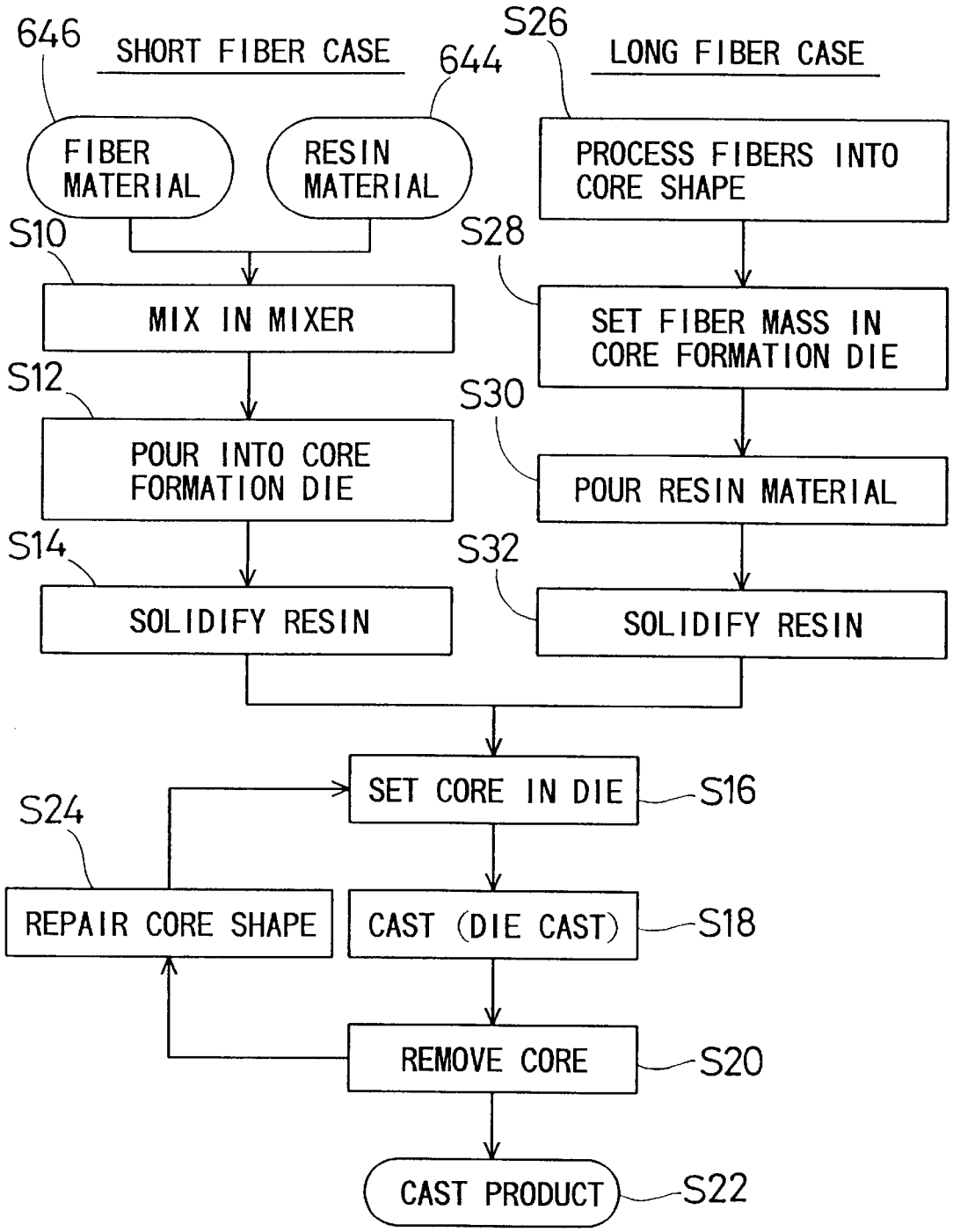
FIG. 28 is a flow chart illustrating a method of preparing the resin core in the twelfth embodiment of the invention.

Now, a specific method of fabrication of such FRP resin core and a procedure of casting using such resin core will be described with reference to FIG. 28. FIG. 28 is a flow chart showing a casting method using an FRP resin core according to this embodiment. As shown in FIG. 28, the method of FRP resin core fabrication is different in the case of using short fibers and in the case of using long fibers.

In the case of using short fibers, resin material 646 and resin material 644 are mixed in a mixer (Step S10). Then, the mixture of fibers and resin is poured in the molten state into a core formation die by an injection molding process or the like (Step S12). The mixture is then cooled and solidified in the die (Step S14), and then taken out as an FRP resin core.

While the process described so far concerns a thermoplastic resin used as the resin material 644, in case of using a thermosetting resin, a mixture of the resin material 644 in the liquid state and the fiber material 646 is poured into the die in Step S12 and thermally solidified in Step S14.

The FRP resin core which is fabricated in this way is set in the cavity of a casting die (Step S16) for die casting (Step S18). After the molten metal has been solidified, the FRP resin core is taken out with its plastic deformation (Step S20), thus completing the cast product (Step S22).

Meanwhile, the FRP resin core having been taken out with plastic deformation is used again as core (Steps S16 to S20) after repair of the deformed portion to the initial predetermined shape (Step S24).

The FRP resin core incorporating heat-resistant fibers therein has increased elasticity as a whole, and its shape restoring force is extremely improved. Thus, after it has been withdrawn with plastic deformation, its deformed portion is restored to a shape close to the initial predetermined shape. It is thus possible to repair the deformed portion to the predetermined shape in a small number of steps, thus permitting effective re-use of the resin core.

In case where long fibers are used as the reinforcement fibers, the shape of resin core is formed with a mass of fibers (Step S26), the mass being set in the core formation die (Step S28). Then, the resin material is poured by the injection molding process or the like into the core formation die (Step S30) to be solidified in the die (Step S32) and then taken out as an FRP resin core.

The following casting process (Steps S16 to S24) is the same as in the case of a resin core using short fibers.

While in this embodiment a silicone rubber type resin has been used as the resin material of the resin core, it is possible to use various other resin materials as well as in the eighth to eleventh embodiments.

Further, while a case of using $Al_2O_3$ fibers as the reinforcement fibers has been shown, it is possible to use various other resin materials as well, such as $SiO_2$ fibers, WC fibers and stainless steel fibers.

Further, since in this embodiment a silicone rubber type material excellent in heat resistance is used as the resin material, it is possible to obtain a peculiar effect that it is possible to produce satisfactorily even large size cast products taking considerable times for the cooling of molten metal, such as the automotive engine cylinder head or cylinder block. In the case of small size and/or small thickness cast products which are obtainable with quick cooling of molten metal, satisfactory results are obtainable even with resin materials having lower heat resistance than that of the silicone type resin material.

Further, since $Al_2O_3$ fibers are used as the reinforcement fibers, there is an advantage that aluminum materials may be die cast without the possibility of undesired reaction of the resin core with molten metal.

Further, with the use of fibers of $Al_2O_3$, $SiO_2$, WC, stainless steel, etc. as the reinforcement fibers suited for the silicone rubber type material, it is possible to mold FRP into large thickness shapes such as resin cores.

The FRP in which carbon fibers are incorporated in epoxy type resin material in the prior art could be molded into only small thickness shapes. In contrast, it has been found with the use of the combination of the silicone rubber type material and fibers of $Al_2O_3$ or the like, it is possible to produce various FRP resin cores having large thickness shapes.

(Thirteenth Embodiment)

Now, a thirteenth embodiment of the invention will be described with reference to FIGS. 29(A) and 29(B).

First, the structure of a resin core 652 in this embodiment and a method of casting using the same resin core will be described with reference to FIG. 29(A). In this embodiment, the resin core 652 is used for die casting of aluminum material "ADC10".

Figure 29A:
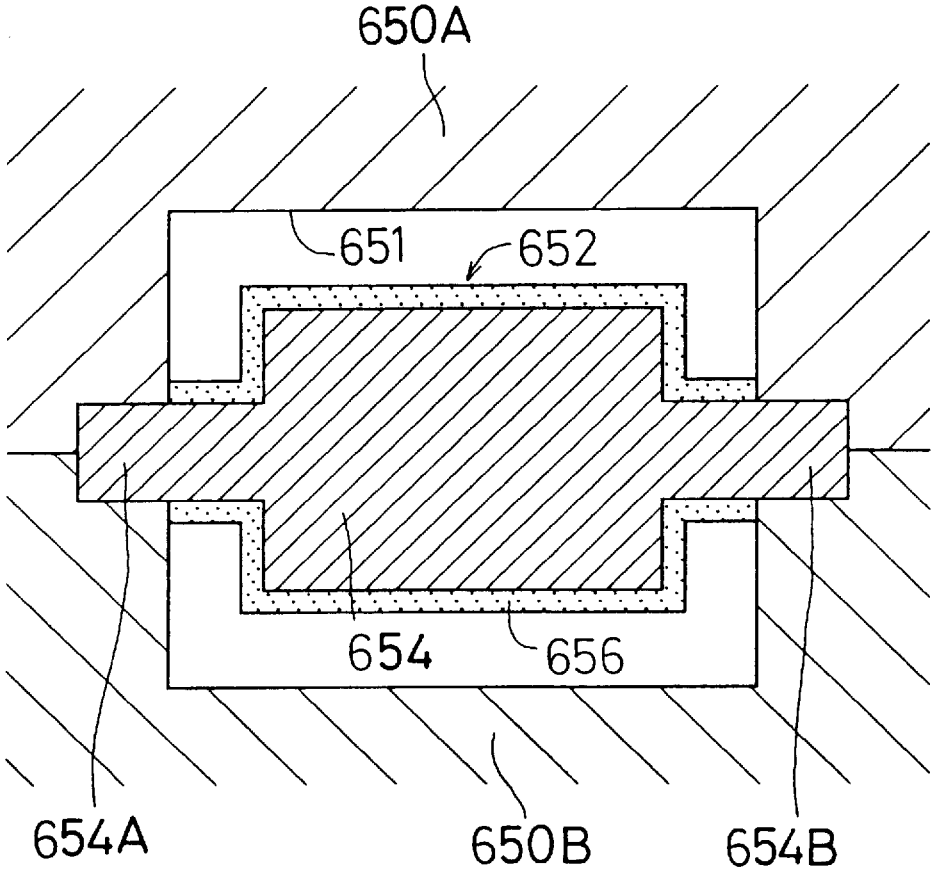
FIGS. 29(A) and 29(B) are a sectional view showing a resin core and a characteristic thereof, respectively, according to a thirteenth embodiment of the invention.
Figure 29B:
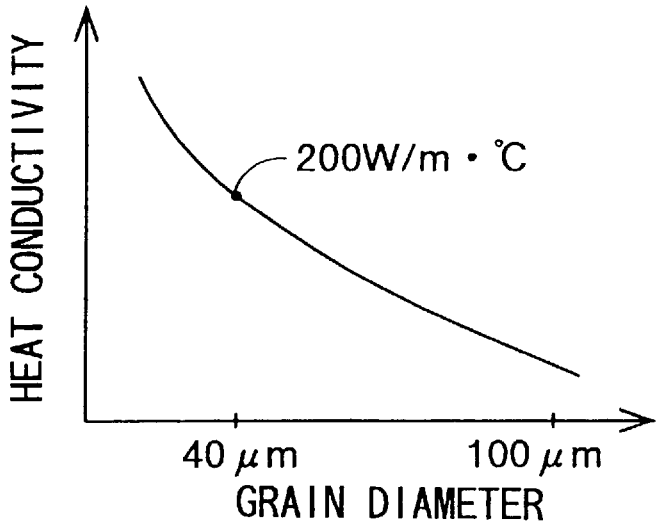

As shown in FIG. 29(A), with the resin core 652 in this embodiment, a portion of the outer surface of resin core body 654 that is to be in contact with molten metal in the cavity is covered with a layer of particles of "ADC10".

A method of forming an aluminum particle layer 656 will now be described. First, the resin core body 654 is molded by the injection molding process. Then, aluminum particles are sprinkled over the resin core body 654 right after the molding, that is, right after being taken out from the injection molding die.

Since the resin core body 654 right after it has been molded still is at a high enough temperature so that its surface is soft, the sprinkled aluminum particles are attached uniformly to the surface of the resin core body 654. After aluminum particles have been attached to a necessary thickness, the system is cooled and thus solidified, so that the resin core 652 with the aluminum particle layer 656 as covering layer can be obtained.

In this embodiment, the aluminum particles for forming the aluminum particle layer 656 have a grain diameter of 40 to 100 $\mu$m.

The portions of the resin core body 654 which is not desired to attach aluminum particles to, such as core prints 654A and 654B at the ends as shown in FIG. 29(A), are suitably covered with tape or the like.

As shown in FIG. 29(A), the resin core 652 which is prepared in the above way is set in a die comprising an upper die half 650A and a lower die half 650B. Then, the die halves 650A and 650B are closed together, and molten aluminum is poured into the cavity 651 thus formed.

At this time, molten metal poured under pressure into the cavity 651 strikes the superficial aluminum particle layer 656 of the resin core 652 but is not brought into contact with the resin core body 654. The resin core body 654 is thus protected from the high temperature, high pressure molten metal and is thus reliably prevented from melting or deformation.

Thus, until the poured molten metal is solidified, the resin core body 654 is not deformed by the high temperature and high pressure of the molten metal but reliably maintains its predetermined shape.

Meanwhile, the superficial aluminum particle layer 656 of the resin core 652 is melted at its surface in contact with the same molten aluminum, and it is made integral with the molten metal which is gradually solidified by cooling. After the poured molten metal has been solidified, the resin core body 654 is softened by the heat of the molten metal, and it is separated from the aluminum particle layer 656 made integral with molten metal. Thus, the resin core body 654 alone is withdrawn while undergoing plastic deformation to be separated from the cast product.

Since the resin core body 654 is protected from the high temperature, high pressure molten metal by the aluminum particle layer 656 which is in contact with the molten metal, the resin core body 654 is free from the possibility of melting or deformation of the resin core body 654 and also does not require separation of the aluminum particle layer 656 and the resin core body 654 after casting, thus permitting the number of steps that are necessary for reusing the resin core.

Further, since in this embodiment the resin core body 654 is covered with aluminum particles, a heat insulating effect can be obtained owing to an air layer which is present between the aluminum particles. It is thus possible to obtain an advantage that it is possible to use resin materials having lower heat resistance compared to the case of covering the resin core body 654 with a dense aluminum layer.

Further, since the volume of air layer present between aluminum particles varies with the size thereof, it is possible to adjust the heat insulation. FIG. 29(B) is a graph showing the relation between the heat conductivity and the grain diameter of the aluminum particles of the aluminum particle layer 656. It will be seen from FIG. 29(B) that the heat conductivity is reduced with increasing grain diameter. That is, the heat insulating property of the aluminum particle layer 656 can be improved by increasing the grain size of aluminum particles.

Thus, selection of the grain diameter of aluminum particles permits control of the heat insulating property of the aluminum particle layer 656, thus permitting control of the time until the resin core body 654 is softened.

While this embodiment has been described in relation to the formation of the aluminum particle layer 656 by sprinkling aluminum particles on the resin core body 654 right after the molding thereof, it is possible to adopt other methods as well, such as a method of attaching aluminum foil on the resin core body 654, a method of coating aluminum particles by using a heat-resistant binder, and a method of dipping a resin core made of silicone resin or like resin material having high heat resistance for a short period of time in molten aluminum at a comparatively low temperature.

Further, while this embodiment has been described in relation to the aluminum material "ADC10" as the casting material, when using a different casting material the resin core body should be covered with the same metal as that casting material.

The above embodiments have mainly been described in relation to the use of the resin core for high pressure casting such as die casting. The resin core in this embodiment, however, is applicable not only to high pressure casting but also to various other types of casting as well, such as low pressure casting, gravitational casting, reduced pressure casting and differential pressure casting.

Further, while mainly the use of aluminum as the casting material has been described, the invention is of course applicable to other casting materials as well.

Further, the methods of fabrication of resin core, method of casting using the same resin core, as well as the constructions, shapes, sizes, materials, quantities, connection relations, etc. of the resin cores and various parts of the equipment for fabricating these resin cores as described in connection with the above embodiments are by no means limitative.

(Fourteenth Embodiment)

Figure 30:
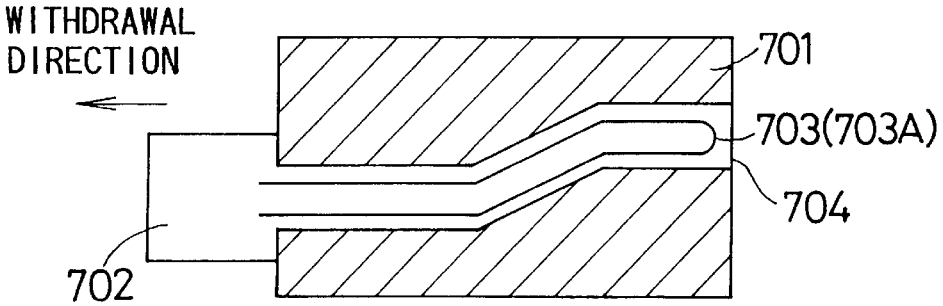
FIG. 30 is a sectional view showing a resin core according to a fourteenth embodiment of the invention.
Figure 31:
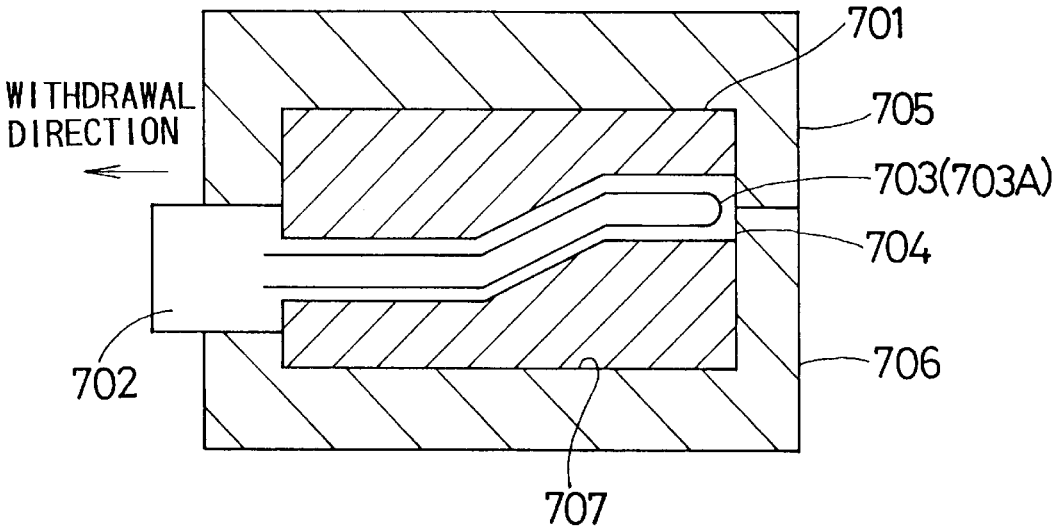
FIG. 31 is a sectional view showing part of a casting apparatus in casting operation using the resin core shown in FIG. 30.
Figure 32:
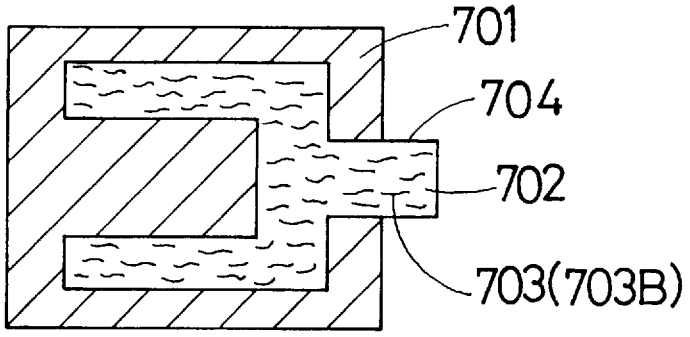
FIG. 32 is a sectional view showing a resin core according to a fifteenth embodiment of the invention.
Figure 33:
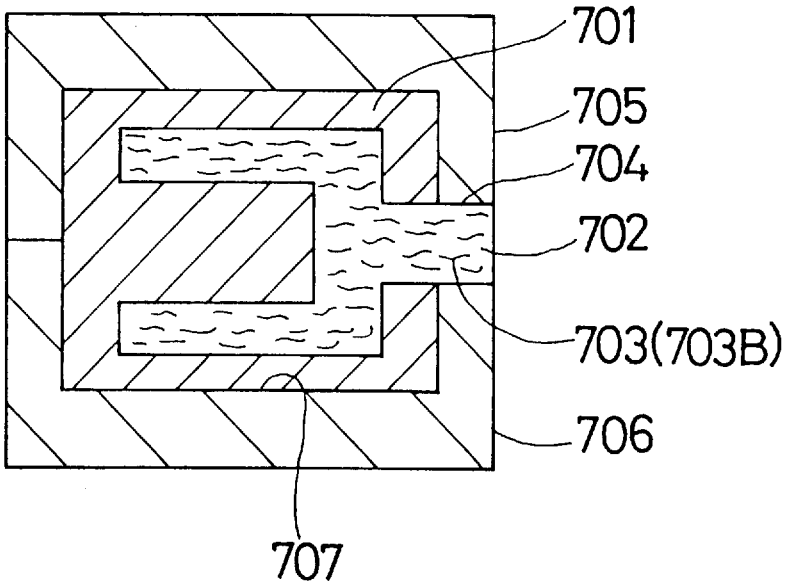
FIG. 33 is a sectional view showing part of a casting apparatus in casting operation using the resin core shown in FIG. 32.

FIGS. 30 and 31 show a fourteenth embodiment of the invention, and FIGS. 32 and 33 show a fifteenth embodiment of the invention. Parts common to both the embodiments are designated by like reference numerals.

First, the structural part which is common to both the embodiments will be described together with its functions with reference to, for instance, FIGS. 30 and 31.

Referring to FIGS. 30 and 31, die halves 705 and 706 which can be opened and closed together define a cavity 707 therebetween. In the cavity 707, a resin core 704 is set for forming a hollow space, an undercut portion, etc. of a cast product 701. A metal, for instance an aluminum alloy, is poured as molten metal into the cavity 707 and is solidified to obtain the cast product 701. After the molten metal has been solidified, the die halves 705 and 706 are opened, and the cast product 701 is taken out. Then, the resin core 704 is withdrawn from the cast product 701.

The resin core 704 comprises a core resin part 702 of a thermoplastic resin and a metal member 703 which is disposed within the core resin part 702 and which can heat this part 702 from the inside thereof.

The thermoplastic resin constituting the core resin part 702 is a poorly elastic resin such that it will not reduce the dimensional accuracy of molding due to its elastic deformation as might otherwise be caused when molten metal (for instance molten aluminum alloy) is poured under a high pressure, for instance 80 MPa or above, into the cavity 707 in die casting. Examples of such poorly elastic resin are polyethylene, ethylene/propylene copolymer, etc. These resins are by no means limitative.

The above poorly elastic resins, however, are hard and can not be deformed at room temperature. Therefore, for removing the resin core 704 from the cast product 701, it is necessary to heat again the cast product 701 accommodating the resin core 704 to a temperature above the softening point of the resin (i.e., about 150° to 200° C.). That is, the core resin part 702 should be made capable of deformation to withdraw the resin core 704 from the cast product 701.

However, when an aluminum alloy cast product produced by the die casting process is heated again, blister defects are generated due to numerous micropores. Therefore, the cast product can not be heated again to a very high temperature. For example, heating the cast product to 500° C. causes generation of blister defects, although the resin core is softened. However, by heating the cast product to 200° to 300° C., the inner portion of the resin core 704 can not be elevated in temperature beyond the softening point of the resin or, if it could, too much time would be taken. Therefore, this method is not feasible. To solve this problem, the metal member 703 is disposed in the core resin part 702. It permits heating of the core resin part 702 from the inside thereof beyond the softening point of the resin, but to an extent not to cause blister defects on the cast product, for instance to 150° to 200° C., in a short period of time.

While the metal member 703 serves to heat the core resin part 702 from the inside thereof, it also has a core breakage prevention function. That is, it prevents the core resin part 702, being pulled for removal from the cast product 701, from being broken and partly left in the cast product 701.

Now, the constructions and functions which are peculiar to the fourteenth and fifteenth embodiments will be described.

In the fourteenth embodiment of the invention, as shown in FIGS. 30 and 31, the metal member 703 disposed in the core resin part 702 is a heat generator 703A made of a metal capable of heat generation when energized. The heat generator 703A is made from, for instance, nichrome wire. The amount of heat generated from the heat generator 703 is controlled through control of the amount of power supplied for energization and the energization time. When the heat generator 703A is disposed to extend parallel to the withdrawal direction, it can be effectively in charge of the withdrawing force.

By heating the cast product 701 with the resin core 704 therein in a heating furnace or with a burner while also heating the heat generator 703A by energization, it is possible to heat the resin core 704 from the inside in a short period of time while also heating the resin to around the softening point thereof, (i.e., 50° to 250° C.) to soften and remove the resin. Thus, it is possible to suppress generation of blister defects. Further, although the resin is deteriorated to be incapable of re-use when heated to a high temperature, the deterioration can be suppressed if the heating temperature is in a comparatively low temperature range of 150° to 250° C., which is effective in view of the recycling.

(Fifteenth Embodiment)

In the fifteenth embodiment of the invention, as shown in FIGS. 32 and 33, the metal member 703 disposed in the core resin part 702 is constituted by a number of wires 703B having better heat conductivity than the resin. The wires 703B may, for instance, be copper wires.

By heating the cast product 701 with the resin core 701 therein in a heating furnace or with a burner, heat is conducted through the copper wires 703B to the core resin part 704. The resin core 704 is thus heated not only from the outside but also from the inside, and thus it is heated in a short period of time, thus obtaining the softening of the entire core resin part 702.

Since the resin core 704 can be heated from the inside as well, there is no need of elevating the outside temperature so much, thus suppressing the blister defect generation, which is desired in view of the re-cycling as well.

Since the wires 703B are effective for improving the tensile strength of the resin core 704, it is possible to apply higher force than in the prior art to the resin core 704 for withdrawal thereof from the cast product 701, as well as preventing the core resin part 702 from being broken in the cast product 701.

(Sixteenth Embodiment)

Figure 34:
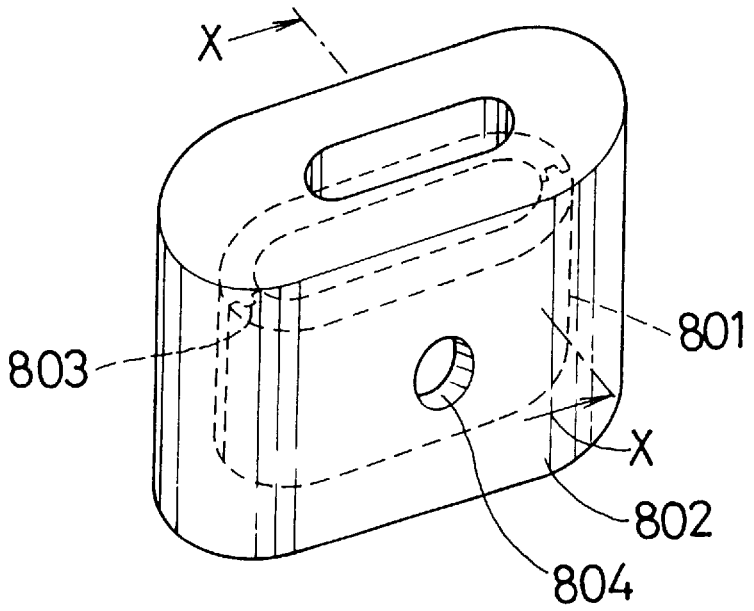
FIG. 34 is a sectional view showing a cast product with a resin core therein.
Figure 35:
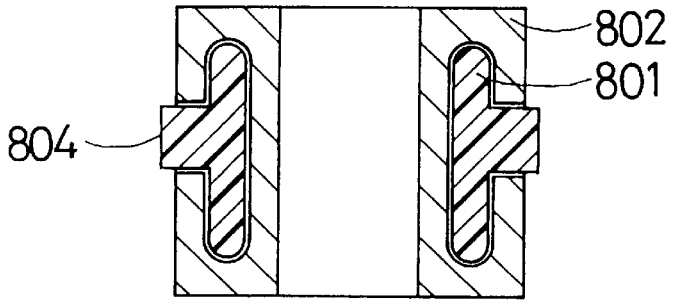
FIG. 35 is a sectional view taken along line X—X in FIG. 34.

FIGS. 34 and 35 show an example of a relation between a cast product 802 and a resin core 801 to which the method according to the invention is applied. The resin core 801 has a shape which is briefly shown in, for instance, FIG. 39. FIGS. 34 and 35 illustrate the state of the system after casting, in which the resin core 801 is still present in the cast product 802 and has to be withdrawn therefrom. In this state, the resin core 801 extends in a ring-like fashion through the cast product 802, and it can not be withdrawn through a core print hole 804 even when the resin core 802 is softened. To permit withdrawal of the resin core 801 through the core print hole 804, the resin core 801 has to be circumferentially separated into at least two portions. To this end, the resin core 801 is provided with parting sections 803 at which the resin core 801 is parted by a pulling force applied when the resin core 801 is set in the die. The resin core 801 may have various structures depending on the structure of the parting section 803. According to the invention, the resin core 801 is classified in dependence on the structure of the parting section 803 into a combination type resin core and a notch type integral resin core. The combination type resin core is further classified into adhesive type and non-adhesive type resin cores. These resin cores will be described hereinunder as embodiments of the invention.

(Seventeenth Embodiment)

This embodiment concerns a combination type resin core which can not be easily removed from core print 804 if it is a one-piece member and accordingly which consists of a plurality of divisions which are assembled together to be used for casting. The core divisions may be assembled together by using an adhesive or without use of any adhesive. The seventeenth embodiment of the invention concerns a method of withdrawing a resin core with divisions thereof bonded together with an adhesive (hereinafter referred to adhesive type resin core 801A).

Figure 36:
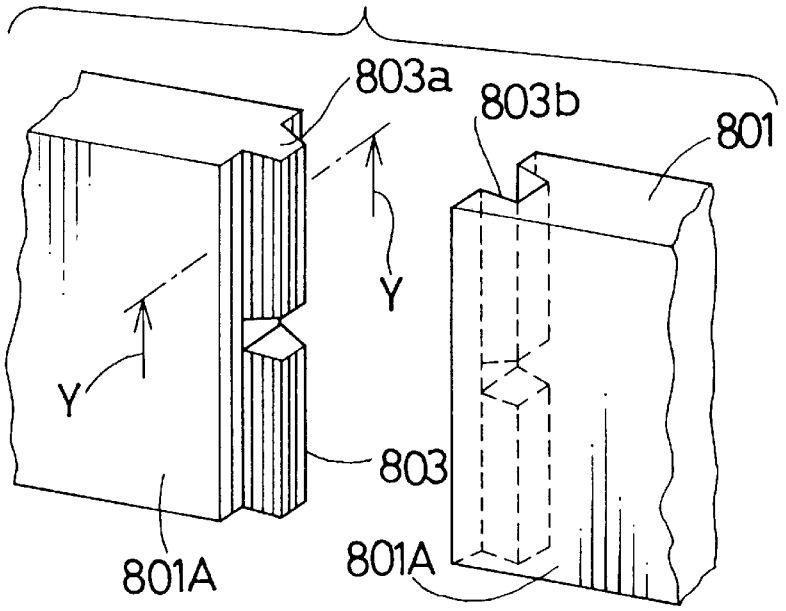
FIG. 36 is a fragmentary exploded perspective view showing a resin core with parting portions according to a seventeenth embodiment of the invention.
Figure 37:
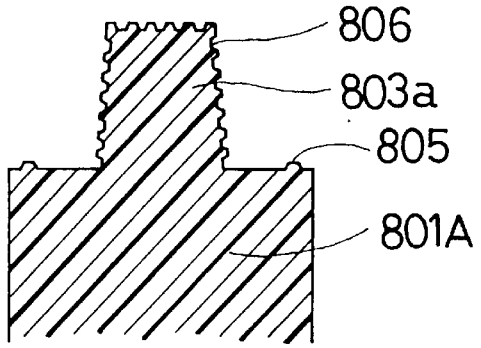
FIG. 37 is a sectional view taken along line Y—Y in FIG. 36.
Figure 38:
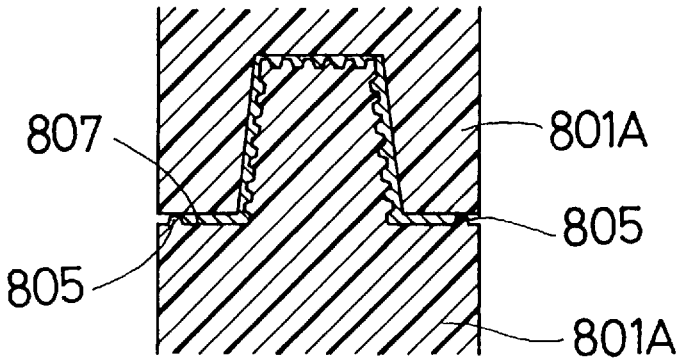
FIG. 38 is a sectional view showing resin core divisions shown in FIG. 36 that have been assembled and bonded together.
Figure 39:
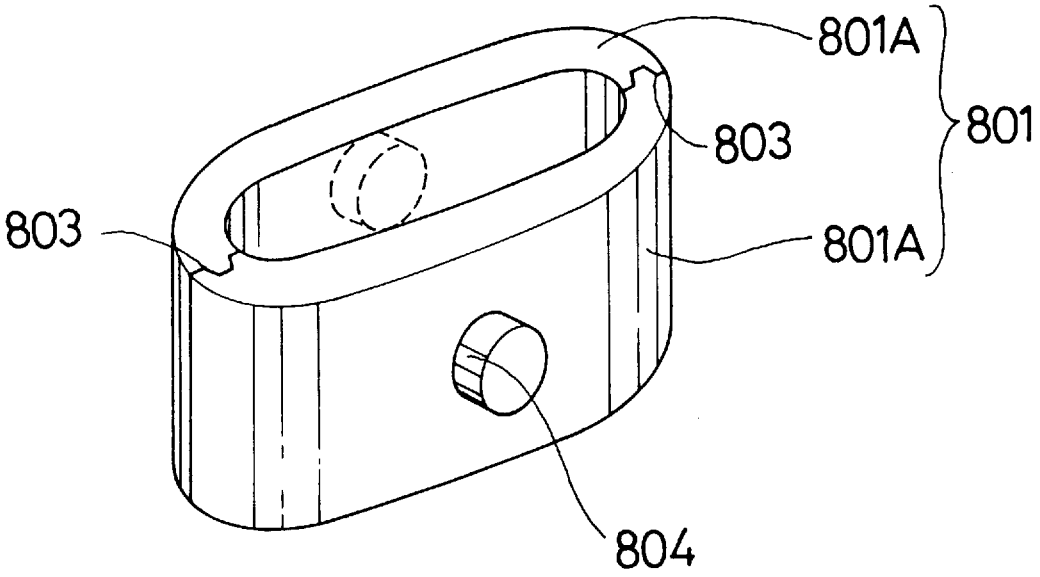
FIG. 39 is a perspective view showing the resin core shown in FIG. 34 in which the parting structure of resin core shown in FIG. 36 is applied.
Figure 40:
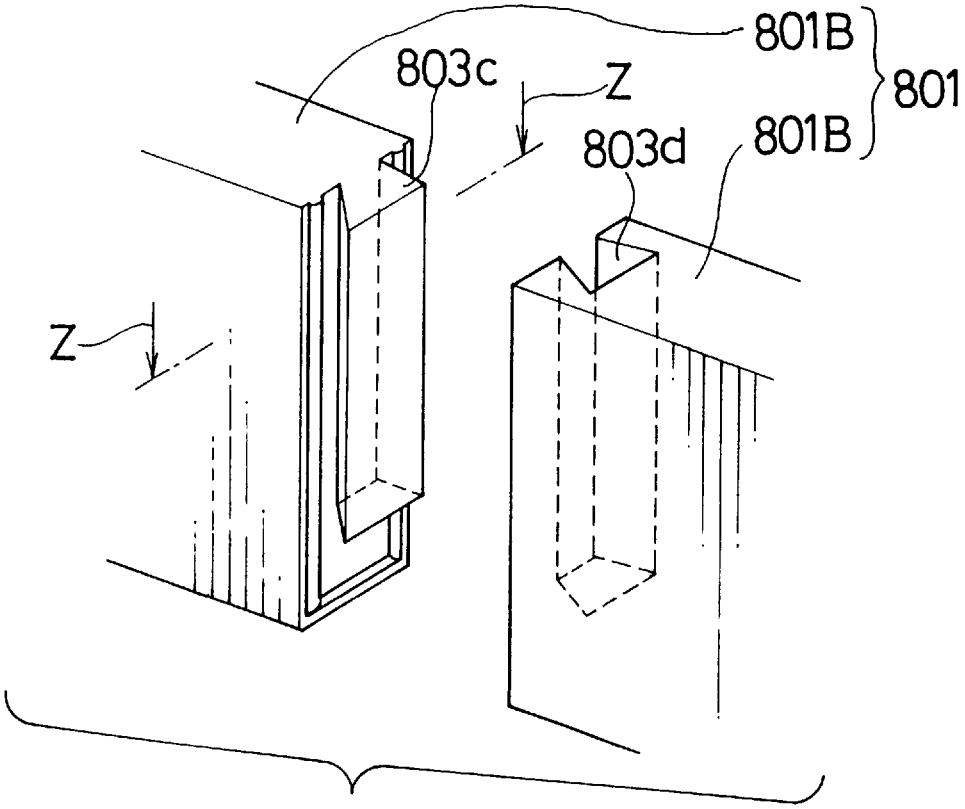
FIG. 40 is a fragmentary exploded perspective view showing a resin core with parting portions according to an eighteenth embodiment of the invention.

FIGS. 36 to 39 show an outline of the adhesive type resin core 801A. This resin core which consists of a plurality of divisions. Each parting section 803 comprises a raised portion 803*a* formed on a bonding end face of a core division and having a sectional profile tapering toward the free end and a recessed portion 803*b* formed in an associated bonding end face of another core division and flaring toward the open side for receiving the raised portion 803*a*. The raised portion 803*a* and the recessed portion 803*b* are engaged together, and the two bonding end faces are bonded together with an adhesive. Desirably, one bonding end face of at least one of the core divisions is provided with a small ridge 805 and small grooves 806. FIG. 38 shows a state in which the raised and recessed portions shown in FIG. 36 are engaged and bonded together with an adhesive. FIG. 39 shows an application of the structure of engaging and bonding the raised and recessed portions in the seventeenth embodiment to the resin core shown in FIGS. 34 and 35. The provision of the grooves 806 has an effect of increasing the area of the raised and recessed engagement surfaces to enhance the effect of the adhesive 807 and to provide for firmer bonding of the core divisions. The ridge 805 has an aim of sealing the bonding end faces with each other with the elasticity of the resin when the bonding end faces are engaged together for bonding. It is thus possible to prevent adhesive 807 from getting out through between the bonding end faces and also prevent molten metal (for instance molten aluminum) from getting in through between the bonding end faces, thus improving the quality of the cast product. Further, the structure of the parting section comprising the raised and recessed portions serves to position the core divisions when assembling the resin core, thus ensuring high accuracy of the dimensions and the shape of the resin core.

With the combination type resin core having the above structure, by applying a pulling force to the resin core 801 in a softened state thereof (which may be brought about either by residual heat of the cast product or by heating) in a resin core removal step after casting, the resin core 801 is parted at each parting section 803 constituted by the mate bonding end faces. Thus, the resin core 801 can be removed through the core print hole 804 more readily than in the prior art and without possibility of leaving resin or foreign matter in the cast product.

(Eighteenth Embodiment)

The eighteenth embodiment of the invention concerns a method of withdrawing a combination type resin core without use of any adhesive (hereinafter referred to as non-adhesive type resin core 801B).

Figure 41:
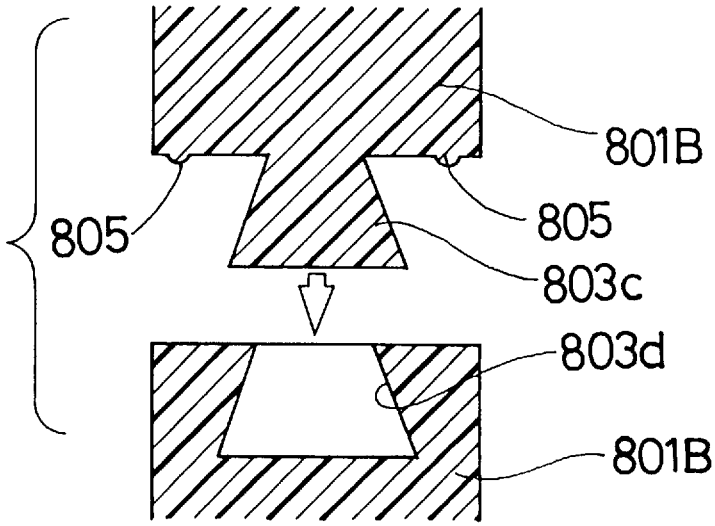
FIG. 41 is a sectional view taken along line Z—Z in FIG. 40.
Figure 42:
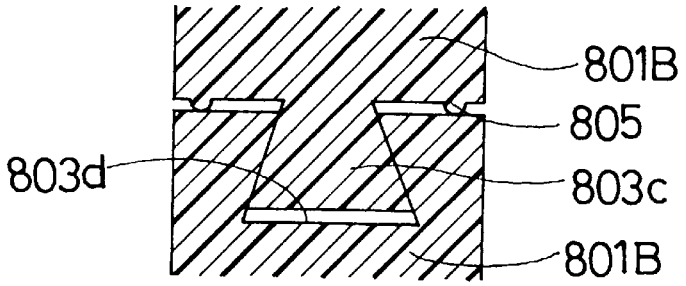
FIG. 42 is a sectional view showing the resin core shown in FIG. 40 in the assembled state.
Figure 43:
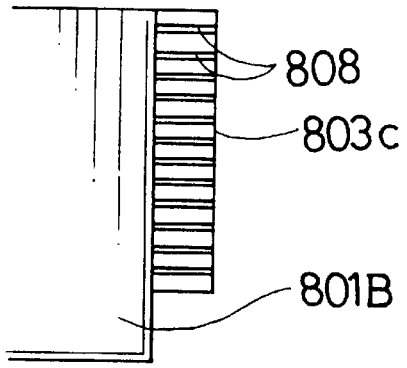
FIG. 43 is a sectional view showing a parting portion of the resin core shown in FIG. 40.

FIGS. 40 to 43 show the non-adhesive type resin core 801B. In this resin core which consists of a plurality of core divisions, each parting section 803 comprises a raised portion 803*c* formed on a bonding end face of a core division and flaring toward the free end and a recessed portion 803*d*formed in an associated bonding end face of another core division and tapered toward the opening side for receiving the raised portion 803*c*. The raised and recessed portions 803*c* and 803*d* are engaged with each other in their hard state such that they can no longer be detached from each other. As shown in FIGS. 41 and 42, one bonding end face of at least one of the core divisions has ridges 805. The ridges 805 have a seal function to prevent molten metal from entering through between the bonding end faces. Further, as shown in FIG. 43, the side surfaces of at least either the raised portion 803*c* or the recessed portion 803*d* may have ridges 808. The ridges 808 have a function to prevent deviation of the raised and recessed portions 803*c* and 803*d* from each other.

When such non-adhesive type combination resin core 801B is used for casting, by applying a pulling force to the resin core 801 in a softened state thereof in a resin core removal step after casting, the raised and recessed portions 803*c* and 803*d* are deformed, and thus the resin core 801 is separated into a plurality of divisions at the parting sections 803. Thus, the individual core divisions can be readily removed through the respective core print holes. At this time, the resin is not melted. That is, it is in its softened state and can transmit the pulling force. Thus, the resin core can be withdrawn without leaving any portion of it in the cast product.

(Nineteenth Embodiment)

The nineteenth embodiment of the invention concerns a method of withdrawing a resin core 801 having notches formed at a plurality of positions, the resin core being incapable of ready removal through core print holes 804 if the notches are not provided but capable of being separated at each of the notches when a pulling force is applied thereto, thus permitting withdrawal of each division thereof through the associated core print hole (the resin core being hereinafter referred to as notch type integral resin core 801C).

Figure 44:
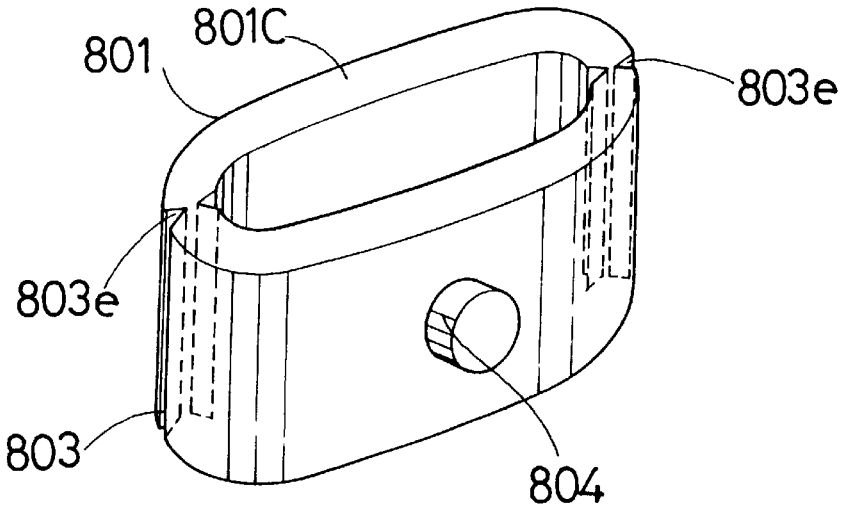
FIG. 44 is a perspective view showing a resin core with parting portions according to a nineteenth embodiment of the invention.
Figure 45:
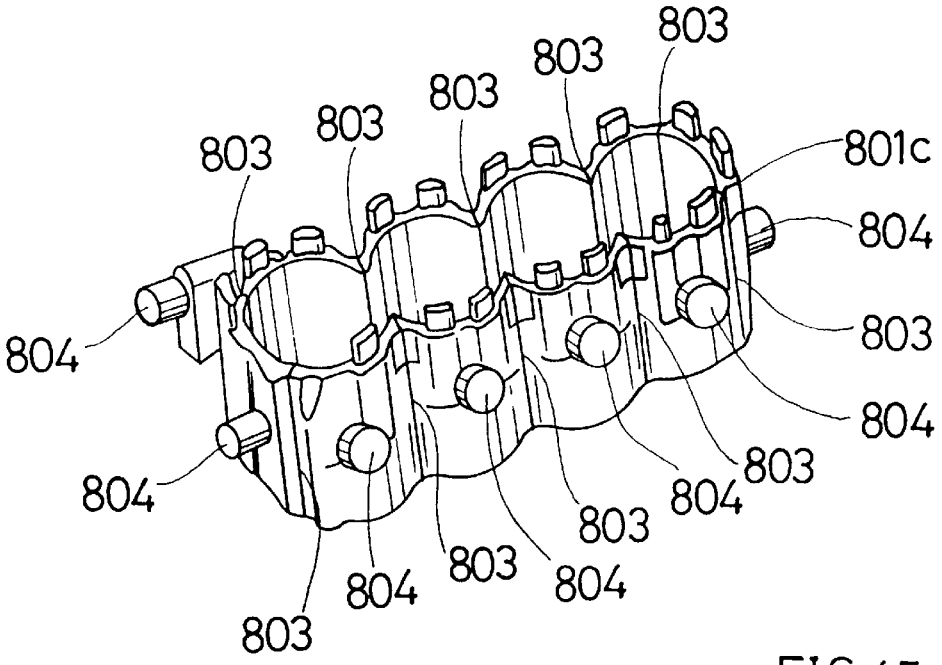
FIG. 45 is a perspective view showing a cylinder block water jacket resin core of an internal combustion engine which adopts the parting structure shown in FIG. 44.
Figure 46:
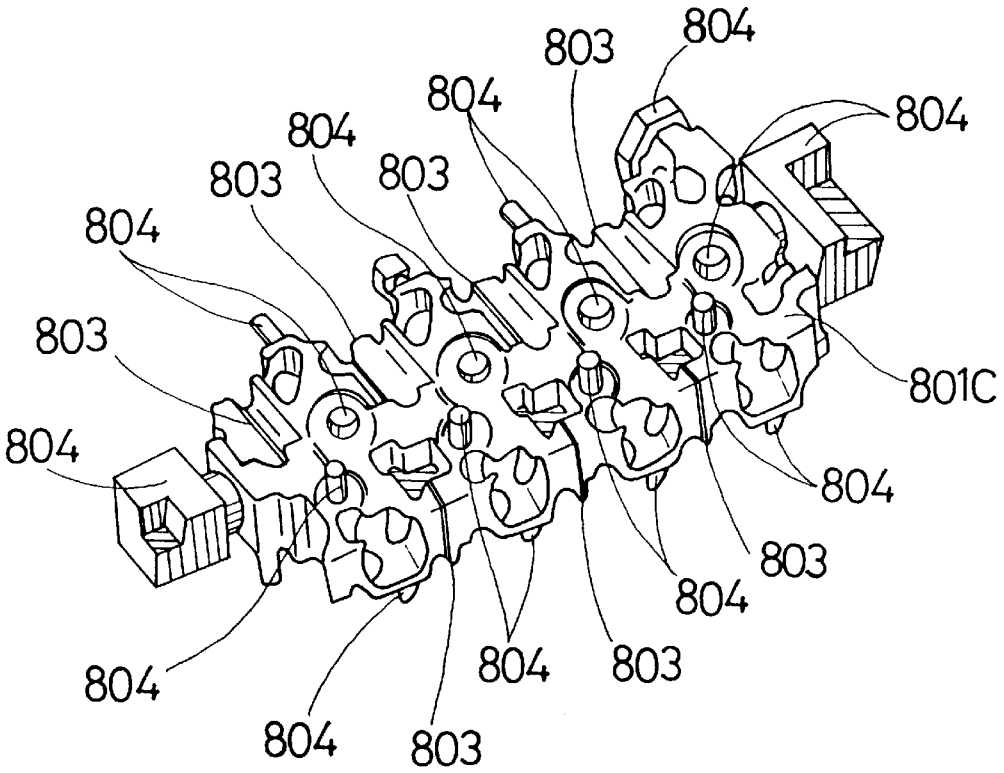
FIG. 46 is a perspective view showing a cylinder head water jacket resin core of an internal combustion engine which adopts the parting structure shown in FIG. 44.

FIGS. 44 to 46 show an outline of the notch type integral resin core 801C. This resin core 801*c* has a plurality of parting sections 803 each constituted by a notch 803*e* formed therein. When a pulling force is applied to the resin core, it is separated at the notches 803*e* into a plurality of core divisions. The notches 803*e* are V-shaped in sectional profile, and they are provided in pairs the notches are formed in the inner and outer surfaces of the resin core and facing each other. FIG. 44 shows a notch type integral resin core 801C which is applied to the resin core as shown in FIGS. 34 and 35 and which can not be readily removed without notches. FIG. 45 shows application of notch type integral resin core 801C to a four-cylinder internal combustion engine cylinder block water jacket core. FIG. 46 shows application of notch type integral resin core 801C to a four-cylinder internal combustion engine cylinder head water jacket core. In FIGS. 45 and 46, designated at 803 are parting sections constituted by notches, and at 804 are portions corresponding to core prints.

When the above notch type integral resin core 801C is used for casting, by applying a pulling force to the resin core in the softened state thereof in a core removal step after the casting, the resin core is separated at the notches 803 into a plurality of core divisions. Thus, the resin core can be readily removed by withdrawing the individual divisions thereof through the respective core print 804. Further, since each core division is not melted, it can be withdrawn integrally without possibility that its resin partly remains in the cast product.

As has been shown, according to the invention, the resin core is provided with parting sections at which the resin core is separated when it is withdrawn from the cast product such that individual divisions thereof can be readily withdrawn. In addition, since the resin core is withdrawn when it is in the softened state, unlike the case where the resin is melted, there is no possibility that the resin partly remains in the cast product.

What is claimed is:

1. A method of manufacturing a cast product, said method comprising the steps of:

(a) disposing a resin core:
  (i) having a high glass transition point;
  (ii) comprising a core print;
  (iiI) in a non-deformable state; and
  (iv) within a die;

(b) filling the die with molten metal, thereby causing the resin core:
  (i) to absorb heat from the molten metal and
  (ii) to achieve a deformable state;

(c) removing the cast product from the die:
  (i) after the molten metal has solidified to form the cast product and
  (ii) by pushing upon the core print; and (d) withdrawing the resin core.

2. A method as in claim 1 wherein the resin core is polycarbonate.

3. A method as in claim 1 wherein the resin core is disposed within the die such that the core print is positioned with respect to at least one pin for pushing out the core print from the die.

4. A method as in claim 1 wherein the resin core is covered with a superficial heat-insulating layer.

5. A method as in claim 1 wherein the resin core is covered with a superficial metal layer.

6. A method as in claim 5 wherein the superficial metal layer has the same composition as the molten metal.

7. A method as in claim 6 wherein the superficial metal layer is a foil layer.

8. A method as in claim 6 wherein the superficial metal layer is a particle layer.

9. A method as in claim 1 wherein the resin core is covered with a superficial heat-resistant fiber layer.

10. A method as in claim 1 wherein the resin core is covered with a superficial ceramic layer.

11. A method as in claim 1 wherein the resin core is covered with a superficial sand layer.

12. A method as in claim 11 wherein:

(a) the resin core is manufactured by injecting a resin into a resin core mold and (b) a sand layer covers an inner wall of the resin core mold.

13. A method as in claim 1 wherein the resin core is reinforced with heat-resistant fibers.

14. A method as in claim 13 wherein the resin core is manufactured by injection molding of a mixture of liquid resin and heat-resistant fibers.

15. A method as in claim 1 wherein:

(a) the resin core is manufactured by assembling together a plurality of resin core divisions and (b) each one of the plurality of resin core divisions has a core print.

16. A method as in claim 15 wherein the resin core is manufactured by bonding together the plurality of resin core divisions.

17. A method as in claim 15 wherein the resin core is manufactured by mechanically assembling the plurality of resin core divisions.

18. A method as in claim 1 wherein the resin core:

(a) has a plurality of core prints and (b) has at least one fragile portion formed between each two adjacent ones of the plurality of core prints.

19. A method as in claim 18 wherein:

(a) the method further comprises the step of applying a pulling force to each one of the plurality of core prints to withdraw the resin core from the cast product;

(b) the resin core separates at the fragile portions; and (c) each separate portion of the resin core is withdrawn individually.

20. A method as in claim 1 wherein:

(a) the die comprises movable cast product set pins and (b) the movable cast product set pins project into the die during the filling step.

21. A method as in claim 20 and further comprising the steps of:

(a) withdrawing the movable cast product set pins from the cast product after the molten metal has solidified and (b) removing the cast product from the die.

22. A method as in claim 1 wherein:

(a) the resin core comprises a heat generating member and (b) the resin core is heated simultaneously by the molten metal and the heat generating member.

23. A method as in claim 22 wherein the heat generating member has an elongate shape.

24. A method of manufacturing a cast product, said method comprising the steps of:

(a) disposing a resin core:

(i) having a high glass transition point;

(ii) having a plurality of core prints and at least one fragile portion formed between each two adjacent ones of the plurality of core prints;

(iii) in a non-deformable state; and (iv) within a die;

(b) filling the die with molten metal, thereby causing the resin core:

(i) to absorb heat from the molten metal and (ii) to achieve a deformable state due to the heat of the molten metal; and (c) withdrawing the resin core:

(i) in the deformable state;

(ii) after the molten metal has solidified to form the cast product.

25. A method as in claim 24 wherein the withdrawal of the resin core is executed concurrently with opening of the die.

26. A method as in claim 24 wherein the resin core is disposed within the die such that the core print is positioned with respect to at least one pin for pushing out the core print from the die.

27. A method as in claim 24 wherein the resin core is covered with a superficial heat-insulating layer.

28. A method as in claim 24 wherein the resin core is covered with a superficial metal layer.

29. A method as in claim 28 wherein the superficial metal layer has the same composition as the molten metal.

30. A method as in claim 29 wherein the superficial metal layer is a foil layer.

31. A method as in claim 29 wherein the superficial metal layer is a particle layer.

32. A method as in claim 24 wherein the resin core is covered with a superficial heat-resistant fiber layer.

33. A method as in claim 24 wherein the resin core is covered with a superficial ceramic layer.

34. A method as in claim 24 wherein the resin core is covered with a superficial sand layer.

35. A method as in claim 34 wherein:

(a) the resin core is manufactured by injecting a resin into a resin core mold and (b) a sand layer covers an inner wall of the resin core mold.

36. A method as in claim 24 wherein the resin core is reinforced with heat-resistant fibers.

37. A method as in claim 36 wherein the resin core is manufactured by injection molding of a mixture of liquid resin and heat-resistant fibers.

38. A method as in claim 24 wherein:

(a) the resin core is manufactured by assembling together a plurality of resin core divisions and (b) each one of the plurality of resin core divisions has a core print.

39. A method as in claim 38 wherein the resin core is manufactured by bonding together the plurality of resin core divisions.

40. A method as in claim 38 wherein the resin core is manufactured by mechanically assembling the plurality of resin core divisions.

41. A method as in claim 24 wherein:

(a) the method further comprises the step of applying a pulling force to each one of the plurality of core prints to withdraw the resin core from the cast product;

(b) the resin core separates at the fragile portions; and (c) each separate portion of the resin core is withdrawn individually.

42. A method as in claim 24 wherein:

(a) the die comprises movable cast product set pins and (b) the movable cast product set pins project into the die during the filling step.

43. A method as in claim 42 and further comprising the steps of:

(a) withdrawing the movable cast product set pins from the cast product after the molten metal has solidified and (b) removing the cast product from the die.

44. A method as in claim 24 wherein:

(a) the resin core comprises a heat generating member and (b) the resin core is heated simultaneously by the molten metal and the heat generating member.

45. A method as in claim 44 wherein the heat generating member has an elongate shape.

46. A method of manufacturing a cast product, said method comprising the steps of:

(a) disposing a resin core:
  (i) having a high glass transition point;
  (ii) in a non-deformable state;
  (iii) within a die; and
  (iv) which comprises movable cast product set pins;

(b) filling the die with molten metal, thereby causing the resin core:
  (i) to absorb heat from the molten metal and
  (ii) to achieve a deformable state due to the heat of the molten metal;

(c) causing the movable cast product set pins to project into the die during the filling step; and (d) withdrawing the resin core:
  (i) in the deformable state;
  (ii) while the movable cast product set pins project into the die; and
  (iii) after the molten metal has solidified to form the cast product.

47. A method as in claim 46 wherein the withdrawal of the resin core is executed concurrently with opening of the die.

48. A method as in claim 46 wherein the resin core is disposed within the die such that the core print is positioned with respect to at least one pin for pushing out the core print from the die.

49. A method as in claim 46 wherein the resin core is covered with a superficial heat-insulating layer.

50. A method as in claim 46 wherein the resin core is covered with a superficial metal layer.

51. A method as in claim 50 wherein the superficial metal layer has the same composition as the molten metal.

52. A method as in claim 51 wherein the superficial metal layer is a foil layer.

53. A method as in claim 51 wherein the superficial metal layer is a particle layer.

54. A method as in claim 46 wherein the resin core is covered with a superficial heat-resistant fiber layer.

55. A method as in claim 46 wherein the resin core is covered with a superficial ceramic layer.

56. A method as in claim 46 wherein the resin core is covered with a superficial sand layer.

57. A method as in claim 56 wherein:

(a) the resin core is manufactured by injecting a resin into a resin core mold and (b) a sand layer covers an inner wall of the resin core mold.

58. A method as in claim 46 wherein the resin core is reinforced with reinforced heat-resistant fibers.

59. A method as in claim 58 wherein the resin core is manufactured by injection molding of a mixture of liquid resin and heat-resistant fibers.

60. A method as in claim 46 wherein:

(a) the resin core is manufactured by assembling together a plurality of resin core divisions and (b) each one of the plurality of resin core divisions has a core print.

61. A method as in claim 60 wherein the resin core is manufactured by bonding together the plurality of resin core divisions.

62. A method as in claim 60 wherein the resin core is manufactured by mechanically assembling the plurality of resin core divisions.

63. A method as in claim 46 wherein:

(a) the resin core:
  (i) has a plurality of core prints and
  (ii) has at least one fragile portion formed between each two adjacent ones of the plurality of core prints;

(b) the method further comprises the step of applying a pulling force to each one of the plurality of core prints to withdraw the resin core from the cast product;

(c) the resin core separates at the fragile portions; and (e) each separate portion of the resin core is withdrawn individually.

64. A method as in claim 46 and further comprising the steps of:

(a) withdrawing the movable cast product set pins from the cast product after the molten metal has solidified and (b) removing the cast product from the die.

65. A method as in claim 46 wherein:

(a) the resin core comprises a heat generating member and (b) the resin core is heated simultaneously by the molten metal and the heat generating member.

66. A method as in claim 65 wherein the heat generating member has an elongate shape.

67. A method of manufacturing a cast product, said method comprising the steps of:

(a) disposing a resin core:
  (i) having a high glass transition point;
  (ii) in a non-deformable state; and
  (iii) within a die;

(b) filling the die with molten metal, thereby causing the resin core:
  (i) to absorb heat from the molten metal and
  (ii) to achieve a deformable state due to the heat of the molten metal; and (c) applying a continuous pulling force to the resin core while the resin core is being heated, thereby permitting the resin core to be withdrawn from the cast product at the tine that the resin core transitions from the non-deformable state to the deformable state.

68. A method as in claim 67 wherein the withdrawal of the resin core is executed concurrently with opening of the die.

69. A method as in claim 67 wherein the resin core is disposed within the die such that the core print is positioned with respect to at least one pin for pushing out the core print from the die.

70. A method as in claim 67 wherein the resin core is covered with a superficial heat-insulating layer.

71. A method as in claim 67 wherein the resin core is covered with a superficial metal layer.

72. A method as in claim 71 wherein the superficial metal layer has the same composition as the molten metal.

73. A method as in claim 72 wherein the superficial metal layer is a foil layer.

74. A method as in claim 72 wherein the superficial metal layer is a particle layer.

75. A method as in claim 67 wherein the resin core is covered with a superficial heat-resistant fiber layer.

76. A method as in claim 67 wherein the resin core is covered with a superficial ceramic layer.

77. A method as in claim 67 wherein the resin core is covered with a superficial sand layer.

78. A method as in claim 77 wherein:

(a) the resin core is manufactured by injecting a resin into a resin core mold and (b) a sand layer covers an inner wall of the resin core mold.

79. A method as in claim 67 wherein the resin core is reinforced with heat-resistant fibers.

80. A method as in claim 79 wherein the resin core is manufactured by injection molding of a mixture of liquid resin and heat-resistant fibers.

81. A method as in claim 67 wherein:

(a) the resin core is manufactured by assembling together a plurality of resin core divisions and (b) each one of the plurality of resin core divisions has a core print.

82. A method as in claim 81 wherein the resin core is manufactured by bonding together the plurality of resin core divisions.

83. A method as in claim 81 wherein the resin core is manufactured by mechanically assembling the plurality of resin core divisions.

84. A method as in claim 67 wherein:

(a) the resin core:

(i) has a plurality of core prints and (ii) has at least one fragile portion formed between each two adjacent ones of the plurality of core prints;

(b) the method further comprises the step of applying the continuous pulling force to each one of the plurality of core prints to withdraw the resin core from the cast product;

(c) the resin core separates at the fragile portions; and (d) each separate portion of the resin core is withdrawn individually.

85. A method as in claim 67 wherein:

(a) the die comprises movable cast product set pins;

(b) the movable cased product set pins project into the die during the filling step; and (c) the method further comprises the steps of:

(i) withdrawing the movable cast product set pins from the cast product after the molten metal has solidified and (ii) removing the cast product from the die.

86. A method as in claim 67 wherein:

(a) the resin core comprises a heat generating member and (b) the resin core is heated simultaneously by the molten metal and the heat generating member.

87. A method as in claim 86 wherein the heat generating member has an elongate shape.

* * * * *